US012410956B2

(12) United States Patent
Iyoshi et al.

(10) Patent No.: US 12,410,956 B2
(45) Date of Patent: Sep. 9, 2025

(54) REFRIGERATION CYCLE SYSTEM

(71) Applicant: DAIKIN INDUSTRIES, LTD., Osaka (JP)

(72) Inventors: Yuta Iyoshi, Osaka (JP); Yoshiki Yamanoi, Osaka (JP); Kumiko Saeki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 177 days.

(21) Appl. No.: 18/204,002

(22) Filed: May 31, 2023

(65) Prior Publication Data

US 2023/0304711 A1 Sep. 28, 2023

Related U.S. Application Data

(63) Continuation of application No. PCT/JP2021/043882, filed on Nov. 30, 2021.

(30) Foreign Application Priority Data

Dec. 1, 2020 (JP) ..... 2020-199794

(51) Int. Cl.
*F25B 47/02* (2006.01)
*F25B 9/00* (2006.01)
(Continued)

(52) U.S. Cl.
CPC ..... *F25B 47/025* (2013.01); *F25B 9/008* (2013.01); *F25B 9/10* (2013.01); *F25B 13/00* (2013.01);
(Continued)

(58) Field of Classification Search
CPC ..... F25B 47/025; F25B 9/008; F25B 9/10; F25B 13/00; F25B 2313/007; F25B 2313/0233
See application file for complete search history.

(56) References Cited

U.S. PATENT DOCUMENTS

2004/0134225 A1* 7/2004 Sakamoto ..... F25B 9/008 62/513

FOREIGN PATENT DOCUMENTS

CN 102884384 A 1/2013
CN 203940649 U 11/2014
(Continued)

OTHER PUBLICATIONS

International Preliminary Report on Patentability and English translation of the Written Opinion of the International Searching Authority, for International Application No. PCT/JP2021/043882, dated Jun. 15, 2023.
(Continued)

*Primary Examiner* — Henry T Crenshaw
(74) *Attorney, Agent, or Firm* — Birch, Stewart, Kolasch & Birch, LLP

(57) ABSTRACT

A primary refrigerant circuit allows circulation of a primary refrigerant and includes a primary compressor, a cascade heat exchanger, a primary heat exchanger, and a primary switching mechanism. A secondary refrigerant circuit allows circulation of a secondary refrigerant and includes a secondary compressor, the cascade heat exchanger, a utilization heat exchanger, and a secondary switching mechanism. The secondary refrigerant circuit includes a bypass flow path connecting a portion between the utilization heat exchanger and the cascade heat exchanger and a suction flow path of the secondary compressor, and a bypass expansion valve provided on the bypass flow path. Executed is defrosting operation of circulating the primary refrigerant in the order of the primary compressor, the primary heat exchanger, and the cascade heat exchanger, and circulating the second refrigerant in the order of the secondary compressor, the cascade heat exchanger, and the bypass flow path.

20 Claims, 9 Drawing Sheets

(51) Int. Cl.
*F25B 9/10* (2006.01)
*F25B 13/00* (2006.01)

(52) U.S. Cl.
CPC . *F25B 2313/007* (2013.01); *F25B 2313/0233* (2013.01)

(56) References Cited

FOREIGN PATENT DOCUMENTS

| | | | |
|---|---|---|---|
| EP | 1 967 801 | A2 | 9/2008 |
| EP | 2 623 898 | A1 | 8/2013 |
| EP | 3 348 934 | A1 | 7/2018 |
| EP | 3 643 988 | A1 | 4/2020 |
| JP | 59-38568 | A | 3/1984 |
| JP | 2004-190917 | A | 7/2004 |
| JP | 2005-299935 | A | 10/2005 |
| JP | 2007-218460 | A | 8/2007 |
| JP | 2008-39332 | A | 2/2008 |
| JP | 2011-127878 | A | 6/2011 |
| JP | 5113447 | B2 | 1/2013 |
| JP | 2013-210150 | A | 10/2013 |
| JP | 2014-109405 | A | 6/2014 |
| JP | 2016-11783 | A | 1/2016 |
| JP | 2019-20090 | A | 2/2019 |
| WO | WO 2018/235832 | A1 | 12/2018 |

OTHER PUBLICATIONS

Extended European Search Report for European Application No. 21800672.4, dated Sep. 5, 2023.

Extended European Search Report for European Application No. 21900595.6, dated Apr. 11, 2024.

English translation of the International Search Report, for International Application No. PCT/JP2021/017705, dated Jun. 22, 2021.

International Preliminary Report on Patentability and English translation of the Written Opinion of the International Searching Authority, for International Application No. PCT/JP2021/017705, dated Nov. 17, 2022.

International Search Report, for International Application No. PCT/JP2021/043882, dated Jan. 11, 2022.

* cited by examiner

REFRIGERATION CYCLE SYSTEM

CROSS REFERENCE TO RELATED APPLICATIONS

This application is a Continuation of PCT International Application No. PCT/JP2021/043882, filed on Nov. 30, 2021, which claims priority under 35 U.S.C. § 119(a) to Patent Application No. JP 2020-199794, filed in Japan on Dec. 1, 2020, all of which are hereby expressly incorporated by reference into the present application.

TECHNICAL FIELD

The present disclosure relates to a refrigeration cycle system.

BACKGROUND ART

There has conventionally been known a binary refrigeration apparatus including a primary refrigerant circuit and a secondary refrigerant circuit connected to each other via a cascade heat exchanger. Such a binary refrigeration apparatus executes defrosting operation in order to melt frost adhering to an evaporator for the primary refrigerant circuit during a heating cycle.

For example, Patent Literature 1 (Japanese Laid-Open Patent Publication No. 2014-109405) discloses a water heating system configured to achieve a heating cycle in a primary refrigerant circuit and a secondary refrigerant circuit to heat water flowing in a water circuit in a secondary heat exchanger. Proposed herein is to cause a refrigerant to flow in a reverse cycle in each of the primary refrigerant circuit and the secondary refrigerant circuit to increase heat quantity supplied to the evaporator of the primary refrigerant circuit during defrosting operation of melting frost adhering to the evaporator of the primary refrigerant circuit.

SUMMARY

A refrigeration cycle system according to a first aspect includes a first circuit and a second circuit. The first circuit allows circulation of the first refrigerant. The first circuit includes a first compressor, a cascade heat exchanger, a heat source heat exchanger, and a first switching unit. The first switching unit is configured to switch a flow path of the first refrigerant. The second circuit allows circulation of a second refrigerant. The second circuit includes a second compressor, the cascade heat exchanger, a utilization heat exchanger, and a second switching unit. The second switching unit is configured to switch a flow path of the second refrigerant. The second circuit includes a bypass circuit and a controlling valve. The bypass circuit connects a portion between the utilization heat exchanger and the cascade heat exchanger, and a suction flow path of the second compressor. The controlling valve is provided on the bypass circuit. The refrigeration cycle system executes defrosting operation. In the defrosting operation, the first refrigerant circulates in the order of the first compressor, the heat source heat exchanger, and the cascade heat exchanger, and the second refrigerant circulates in the order of the second compressor, the cascade heat exchanger, and the bypass circuit.

DESCRIPTION OF EMBODIMENTS

(1) Configuration of Refrigeration Cycle System

Figure 1:
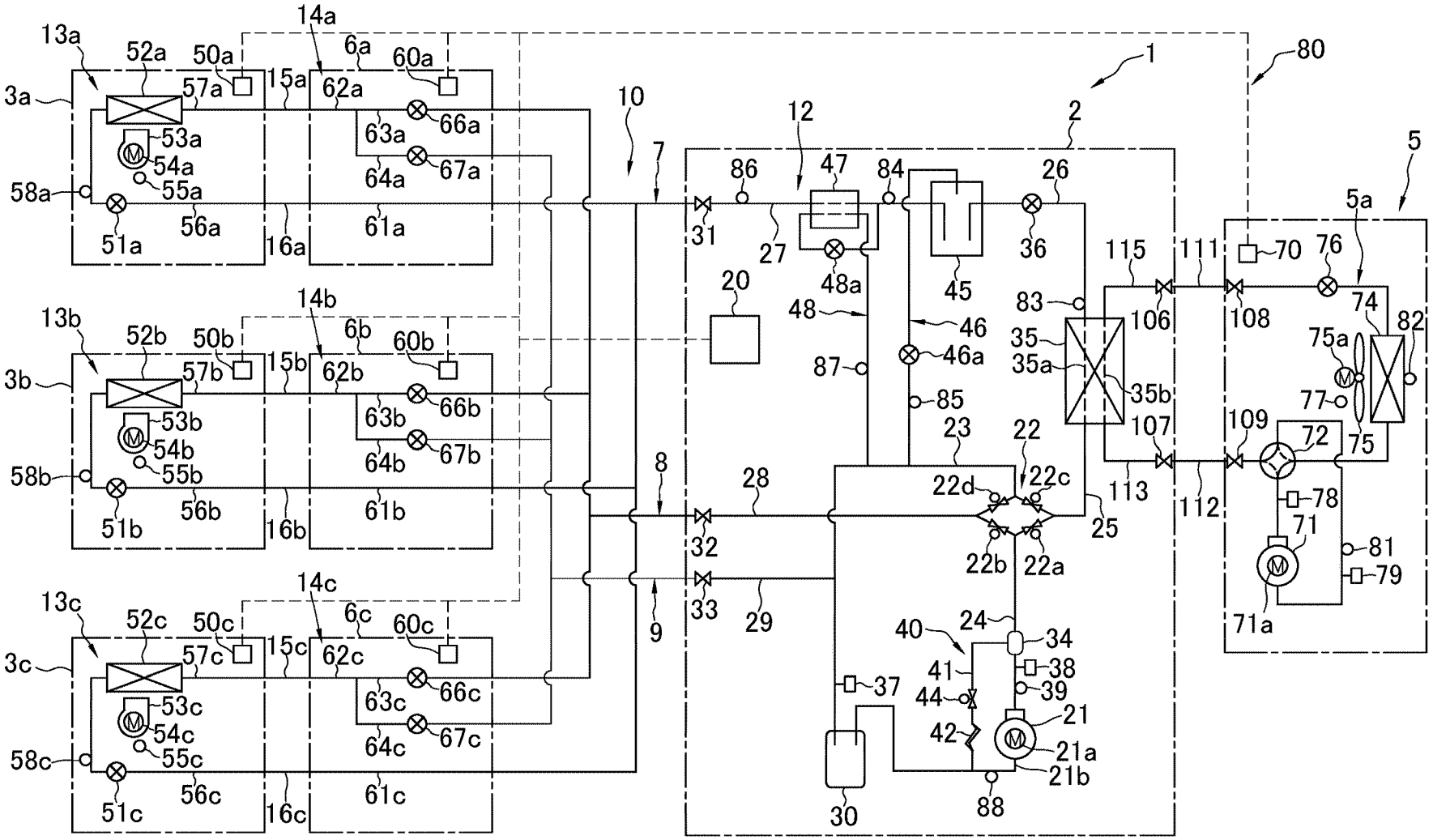
FIG. 1 is a schematic configuration diagram of a refrigeration cycle system.
Figure 2:
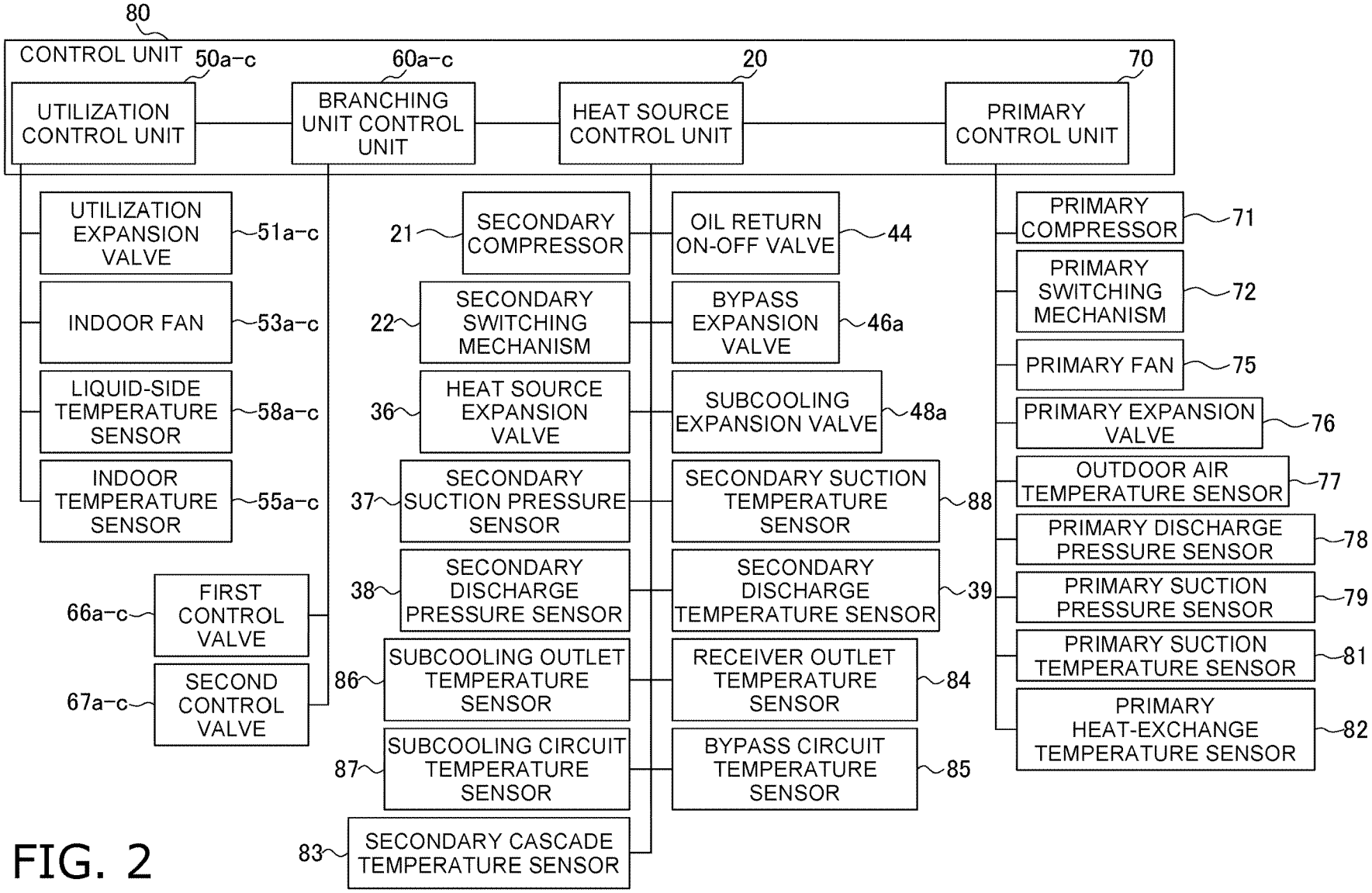
FIG. 2 is a schematic functional block configuration diagram of the refrigeration cycle system.

FIG. 1 is a schematic configuration diagram of a refrigeration cycle system 1. FIG. 2 is a schematic functional block configuration diagram of the refrigeration cycle system 1.

The refrigeration cycle system 1 is configured to execute vapor compression refrigeration cycle operation to be used for cooling or heating an indoor space of a building or the like.

The refrigeration cycle system 1 includes a binary refrigerant circuit consisting of a vapor compression primary refrigerant circuit 5*a* (corresponding to a first circuit) and a vapor compression secondary refrigerant circuit 10 (corresponding to a second circuit), and achieves a binary refrigeration cycle. The primary refrigerant circuit 5*a* encloses a refrigerant such as R32 (corresponding to a first refrigerant) for example. The secondary refrigerant circuit 10 encloses a refrigerant such as carbon dioxide (corresponding to a second refrigerant) for example. The primary refrigerant circuit 5*a* and the secondary refrigerant circuit 10 are thermally connected via a cascade heat exchanger 35 to be described later.

The refrigeration cycle system 1 includes a primary unit 5, a heat source unit 2, a plurality of branching units 6*a*, 6*b*, and 6*c*, and a plurality of utilization units 3*a*, 3*b*, and 3*c*, which are connected correspondingly via pipes. The primary unit 5 and the heat source unit 2 are connected via a primary first connection pipe 111 and a primary second connection pipe 112. The heat source unit 2 and the plurality of branching units 6*a*, 6*b*, and 6*c* are connected via three refrigerant connection pipes, namely, a secondary second connection pipe 9, a secondary first connection pipe 8, and a secondary third connection pipe 7. The plurality of branching units 6*a*, 6*b*, and 6*c* and the plurality of utilization units 3*a*, 3*b*, and 3*c* are connected via first connecting tubes 15*a*, 15*b*, and 15*c* and second connecting tubes 16*a*, 16*b*, and 16*c*. The present embodiment provides the single primary unit 5. The present embodiment provides the single heat source unit 2. The plurality of utilization units 3*a*, 3*b*, and 3*c* according to the present embodiment includes three utilization units, namely, a first utilization unit 3*a*, a second utilization unit 3*b*, and a third utilization unit 3*c*. The plurality of branching units 6*a*, 6*b*, and 6*c* according to the present embodiment includes three branching units, namely, a first branching unit 6*a*, a second branching unit 6*b*, and a third branching unit 6*c*.

In the refrigeration cycle system 1, the utilization units 3*a*, 3*b*, and 3*c* are configured to individually execute cooling operation or heating operation, and a utilization unit executing heating operation can send a refrigerant to a utilization unit executing cooling operation to achieve heat recovery between the utilization units. Specifically, heat recovery is achieved in the present embodiment by executing mainly cooling operation or mainly heating operation of simultaneously executing cooling operation and heating operation. Furthermore, the refrigeration cycle system 1 is configured to balance a heat load of the heat source unit 2 in accordance with heat loads of all the plurality of utilization units 3*a*, 3*b*, and 3*c* also in consideration of heat recovery mentioned above (mainly cooling operation or mainly heating operation).

(2) Primary Refrigerant Circuit

The primary refrigerant circuit 5*a* includes a primary compressor 71 (corresponding to a first compressor), a primary switching mechanism 72 (corresponding to a first switching unit), a primary heat exchanger 74 (corresponding to a heat source heat exchanger), a primary expansion valve 76, a first liquid shutoff valve 108, the primary first connection pipe 111, a second liquid shutoff valve 106, a first connecting pipe 115, the cascade heat exchanger 35 shared with the secondary refrigerant circuit 10, a second connecting pipe 113, a second gas shutoff valve 107, the primary second connection pipe 112, and a first gas shutoff valve 109.

The primary compressor 71 is configured to compress a primary refrigerant, and is exemplarily constituted by a positive-displacement compressor of a scroll type or the like configured to inverter control a compressor motor 71*a* to have variable operating capacity.

In a case where the cascade heat exchanger 35 functions as an evaporator for the primary refrigerant, the primary switching mechanism 72 comes into a fifth connection state of connecting a suction side of the primary compressor 71 and a gas side of a primary flow path 35*b* of the cascade heat exchanger 35 (see solid lines in the primary switching mechanism 72 in FIG. 1). In another case where the cascade heat exchanger 35 functions as a radiator for the primary refrigerant, the primary switching mechanism 72 comes into a sixth connection state of connecting a discharge side of the primary compressor 71 and the gas side of the primary flow path 35*b* of the cascade heat exchanger 35 (see broken lines in the primary switching mechanism 72 in FIG. 1). The primary switching mechanism 72 is thus configured to switch the flow path of the refrigerant in the primary refrigerant circuit 5*a*, and is exemplarily constituted by a four-way switching valve. With change in switching state of the primary switching mechanism 72, the cascade heat exchanger 35 can function as the evaporator or the radiator for the primary refrigerant.

The cascade heat exchanger 35 is configured to cause heat exchange between the primary refrigerant such as R32 and a secondary refrigerant such as carbon dioxide without mixing the refrigerants. The cascade heat exchanger 35 is exemplarily constituted by a plate heat exchanger. The cascade heat exchanger 35 includes a secondary flow path 35*a* belonging to the secondary refrigerant circuit 10, and the primary flow path 35*b* belonging to the primary refrigerant circuit 5*a*. The secondary flow path 35*a* has a gas side connected to a secondary switching mechanism 22 via a third heat source pipe 25, and a liquid side connected to a heat source expansion valve 36 via a fourth heat source pipe 26. The primary flow path 35*b* has the gas side connected to the primary compressor 71 via the second connecting pipe 113, the second gas shutoff valve 107, the primary second connection pipe 112, the first gas shutoff valve 109, and the primary switching mechanism 72, and a liquid side connected to the second liquid shutoff valve 106 via the first connecting pipe 115.

The primary heat exchanger 74 is configured to cause heat exchange between the primary refrigerant and outdoor air. The primary heat exchanger 74 has a gas side connected to a pipe extending from the primary switching mechanism 72. The primary heat exchanger 74 has a liquid side connected to the first liquid shutoff valve 108. Examples of the primary heat exchanger 74 include a fin-and-tube heat exchanger constituted by large numbers of heat transfer tubes and fins.

The primary expansion valve 76 is provided at a portion between the liquid side of the primary heat exchanger 74 and the first liquid shutoff valve 108. The primary expansion valve 76 is an electrically powered expansion valve configured to control a flow rate of the primary refrigerant flowing in the primary refrigerant circuit 5*a* and having a controllable opening degree.

The primary first connection pipe 111 is a pipe connecting the first liquid shutoff valve 108 and the second liquid shutoff valve 106, and connects the primary unit 5 and the heat source unit 2.

The primary second connection pipe 112 is a pipe connecting the first gas shutoff valve 109 and the second gas shutoff valve 107, and connects the primary unit 5 and the heat source unit 2.

The first connecting pipe 115 connects the second liquid shutoff valve 106 and the liquid side of the primary flow path 35*b* of the cascade heat exchanger 35, and is provided at the heat source unit 2.

The second connecting pipe 113 connects the gas side of the primary flow path 35*b* of the cascade heat exchanger 35 and the second gas shutoff valve 107, and is provided at the heat source unit 2.

The first gas shutoff valve 109 is provided at a portion between the primary second connection pipe 112 and the primary switching mechanism 72.

(3) Secondary Refrigerant Circuit

The secondary refrigerant circuit 10 includes the plurality of utilization units 3*a*, 3*b*, and 3*c*, the plurality of branching units 6*a*, 6*b*, and 6*c*, and the heat source unit 2, which are connected correspondingly. Each of the utilization units 3*a*, 3*b*, and 3*c* is connected to a corresponding one of the branching units 6*a*, 6*b*, and 6*c* one by one. Specifically, the utilization unit 3*a* and the branching unit 6*a* are connected via the first connecting tube 15*a* and the second connecting tube 16*a*, the utilization unit 3*b* and the branching unit 6*b* are connected via the first connecting tube 15*b* and the second connecting tube 16*b*, and the utilization unit 3*c* and the branching unit 6*c* are connected via the first connecting tube 15*c* and the second connecting tube 16*c*. Each of the branching units 6*a*, 6*b*, and 6*c* are connected to the heat source unit 2 via three connection pipes, namely, the secondary third connection pipe 7, the secondary first connection pipe 8, and the secondary second connection pipe 9. Specifically, the secondary third connection pipe 7, the secondary first connection pipe 8, and the secondary second connection pipe 9 extending from the heat source unit 2 are each branched into a plurality of pipes connected to the branching units 6*a*, 6*b*, and 6*c*.

The secondary first connection pipe 8 has a flow of either the refrigerant in a gas-liquid two-phase state or the refrigerant in a gas state in accordance with an operating state. Depending on the type of the second refrigerant, the secondary first connection pipe 8 has a flow of the refrigerant in a supercritical state in accordance with the operating state. The secondary second connection pipe 9 has a flow of either the refrigerant in the gas-liquid two-phase state or the refrigerant in the gas state in accordance with the operating state. The secondary third connection pipe 7 has a flow of either the refrigerant in the gas-liquid two-phase state or the refrigerant in a liquid state in accordance with the operating state. Depending on the type of the second refrigerant, the secondary third connection pipe 7 has a flow of the refrigerant in the supercritical state in accordance with the operating state.

The secondary refrigerant circuit 10 includes a heat source circuit 12, branching circuits 14*a*, 14*b*, and 14*c*, and a utilization circuits 13*a*, 13*b*, and 13*c*, which are connected correspondingly.

The heat source circuit 12 principally includes a secondary compressor 21 (corresponding to a second compressor), the secondary switching mechanism 22 (corresponding to a second switching unit), a first heat source pipe 28, a second heat source pipe 29, a suction flow path 23, a discharge flow path 24, the third heat source pipe 25, the fourth heat source pipe 26, a fifth heat source pipe 27, the cascade heat exchanger 35, the heat source expansion valve 36, a third shutoff valve 31, a first shutoff valve 32, a second shutoff valve 33, a secondary accumulator 30, an oil separator 34, an oil return circuit 40, a secondary receiver 45, a bypass circuit 46 (corresponding to a bypass circuit), a bypass expansion valve 46*a*, a subcooling heat exchanger 47, a subcooling circuit 48 (corresponding to a bypass circuit), and a subcooling expansion valve 48*a* (corresponding to a controlling valve).

The secondary compressor 21 is configured to compress the secondary refrigerant, and is exemplarily constituted by a positive-displacement compressor of a scroll type or the like configured to inverter control a compressor motor 21*a* to have variable operating capacity. The secondary compressor 21 is controlled in accordance with an operating load so as to have larger operating capacity as the load increases.

The secondary switching mechanism 22 is configured to switch a connection state of the secondary refrigerant circuit 10, specifically, the flow path of the refrigerant in the heat source circuit 12. The secondary switching mechanism 22 according to the present embodiment includes four switching valves 22*a*, 22*b*, 22*c*, and 22*d* constituted as two-way valves aligned on an annular flow path. The secondary switching mechanism 22 may alternatively be constituted by a plurality of three-way switching valves combined together. The secondary switching mechanism 22 includes the first switching valve 22*a* provided on a flow path connecting the discharge flow path 24 and the third heat source pipe 25, the second switching valve 22*b* provided on a flow path connecting the discharge flow path 24 and the first heat source pipe 28, the third switching valve 22*c* provided on a flow path connecting the suction flow path 23 and the third heat source pipe 25, and the fourth switching valve 22*d* provided on a flow path connecting the suction flow path 23 and the first heat source pipe 28. Each of the first switching valve 22*a*, the second switching valve 22*b*, the third switching valve 22*c*, and the fourth switching valve 22*d* according to the present embodiment is an electromagnetic valve configured to be switchable between an opened state and a closed state.

In a case where the cascade heat exchanger 35 functions as a radiator for the secondary refrigerant, the secondary switching mechanism 22 comes into a first connection state of bringing the first switching valve 22*a* into the opened state to connect a discharge side of the secondary compressor 21 and the gas side of the secondary flow path 35*a* of the cascade heat exchanger 35, and bringing the third switching valve 22*c* into the closed state. In another case where the cascade heat exchanger 35 functions as an evaporator for the secondary refrigerant, the secondary switching mechanism 22 comes into a second connection state of bringing the third switching valve 22*c* into the opened state to connect a suction side of the secondary compressor 21 and the gas side of the secondary flow path 35*a* of the cascade heat exchanger 35, and bringing the first switching valve 22*a* into the closed state. In a case where the secondary refrigerant discharged from the secondary compressor 21 is sent to the secondary first connection pipe 8, the secondary switching mechanism 22 comes into a third connection state of bringing the second switching valve 22*b* into the opened state to connect the discharge side of the secondary compressor 21 and the secondary first connection pipe 8, and bringing the fourth switching valve 22*d* into the closed state. In another case where the refrigerant flowing in the secondary first connection pipe 8 is sucked into the secondary compressor 21, the secondary switching mechanism 22 comes into a fourth connection state of bringing the fourth switching valve 22*d* into the opened state to connect the secondary first connection pipe 8 and the suction side of the secondary compressor 21, and bringing the second switching valve 22*b* into the closed state.

As described above, the cascade heat exchanger 35 is configured to cause heat exchange between the primary refrigerant such as R32 and the secondary refrigerant such as carbon dioxide without mixing the refrigerants. The cascade heat exchanger 35 includes the secondary flow path 35*a* having a flow of the secondary refrigerant in the secondary refrigerant circuit 10 and the primary flow path 35*b* having a flow of the primary refrigerant in the primary refrigerant circuit 5*a*, so as to be shared between the primary unit 5 and the heat source unit 2. The cascade heat exchanger 35 according to the present embodiment is disposed in a heat source casing (not depicted) of the heat source unit 2. The gas side of the primary flow path 35*b* of the cascade heat exchanger 35 extends to the primary second connection pipe 112 via the second connecting pipe 113 and the second gas shutoff valve 107. The liquid side of the primary flow path 35*b* of the cascade heat exchanger 35 extends to the primary first connection pipe 111 outside the heat source casing (not depicted) via the first connecting pipe 115 and the second liquid shutoff valve 106.

The heat source expansion valve 36 is an electrically powered expansion valve having a controllable opening degree and connected to a liquid side of the cascade heat exchanger 35, in order for control and the like of a flow rate of the secondary refrigerant flowing in the cascade heat exchanger 35. The heat source expansion valve 36 is provided on the fourth heat source pipe 26.

Each of the third shutoff valve 31, the first shutoff valve 32, and the second shutoff valve 33 is provided at a connecting port with an external device or pipe (specifically, the connection pipe 7, 8, or 9). Specifically, the third shutoff valve 31 is connected to the secondary third connection pipe 7 led out of the heat source unit 2. The first shutoff valve 32 is connected to the secondary first connection pipe 8 led out of the heat source unit 2. The second shutoff valve 33 is connected to the secondary second connection pipe 9 led out of the heat source unit 2.

The first heat source pipe 28 is a refrigerant pipe connecting the first shutoff valve 32 and the secondary switching mechanism 22. Specifically, the first heat source pipe 28 connects the first shutoff valve 32 and a portion between the second switching valve 22*b* and the fourth switching valve 22*d* in the secondary switching mechanism 22.

The suction flow path 23 connects the secondary switching mechanism 22 and the suction side of the secondary compressor 21. Specifically, the suction flow path 23 connects a portion between the third switching valve 22*c* and the fourth switching valve 22*d* in the secondary switching mechanism 22 and the suction side of the secondary compressor 21. The suction flow path 23 has a halfway portion provided with the secondary accumulator 30.

The second heat source pipe 29 is a refrigerant pipe connecting the second shutoff valve 33 and another halfway portion of the suction flow path 23. The second heat source pipe 29 according to the present embodiment is connected to the suction flow path 23 at a connection point between the portion between the second switching valve 22*b* and the fourth switching valve 22*d* in the secondary switching mechanism 22 and the secondary accumulator 30 on the suction flow path 23.

The discharge flow path 24 is a refrigerant pipe connecting the discharge side of the secondary compressor 21 and the secondary switching mechanism 22. Specifically, the discharge flow path 24 connects the discharge side of the secondary compressor 21 and a portion between the first switching valve 22*a* and the second switching valve 22*b* in the secondary switching mechanism 22.

The third heat source pipe 25 is a refrigerant pipe connecting the secondary switching mechanism 22 and a gas side of the cascade heat exchanger 35. Specifically, the third heat source pipe 25 connects a portion between the first switching valve 22*a* and the third switching valve 22*c* in the secondary switching mechanism 22 and a gas side end of the secondary flow path 35*a* in the cascade heat exchanger 35.

The fourth heat source pipe 26 is a refrigerant pipe connecting the liquid side (opposite to the gas side, and opposite to the side provided with the secondary switching mechanism 22) of the cascade heat exchanger 35 and the secondary receiver 45. Specifically, the fourth heat source pipe 26 connects a liquid side end (opposite end to the gas side) of the secondary flow path 35*a* in the cascade heat exchanger 35 and the secondary receiver 45.

The secondary receiver 45 is a refrigerant reservoir configured to reserve a residue refrigerant in the secondary refrigerant circuit 10. The secondary receiver 45 is provided with the fourth heat source pipe 26, the fifth heat source pipe 27, and the bypass circuit 46 extending outward.

The bypass circuit 46 is a refrigerant pipe connecting a gas phase region corresponding to an upper region in the secondary receiver 45 and the suction flow path 23. Specifically, the bypass circuit 46 is connected between the secondary switching mechanism 22 and the secondary accumulator 30 on the suction flow path 23. The bypass circuit 46 is provided with the bypass expansion valve 46*a*. The bypass expansion valve 46*a* is an electrically powered expansion valve having a controllable opening degree to control quantity of the refrigerant guided from inside the secondary receiver 45 to the suction side of the secondary compressor 21.

The fifth heat source pipe 27 is a refrigerant pipe connecting the secondary receiver 45 and the third shutoff valve 31.

The subcooling circuit 48 is a refrigerant pipe connecting part of the fifth heat source pipe 27 and the suction flow path 23. Specifically, the subcooling circuit 48 is connected between the secondary switching mechanism 22 and the secondary accumulator 30 on the suction flow path 23. The subcooling circuit 48 according to the present embodiment extends to branch from a portion between the secondary receiver 45 and the subcooling heat exchanger 47.

The subcooling heat exchanger 47 is configured to cause heat exchange between the refrigerant flowing in a flow path belonging to the fifth heat source pipe 27 and the refrigerant flowing in a flow path belonging to the subcooling circuit 48. The subcooling heat exchanger 47 according to the present embodiment is provided between a portion from where the subcooling circuit 48 branches and the third shutoff valve 31 on the fifth heat source pipe 27. The subcooling expansion valve 48*a* is provided between a portion branching from the fifth heat source pipe 27 and the subcooling heat exchanger 47 on the subcooling circuit 48. The subcooling expansion valve 48*a* is an electrically powered expansion valve having a controllable opening degree and configured to supply the subcooling heat exchanger 47 with a decompressed refrigerant.

The secondary accumulator 30 is a reservoir configured to reserve the secondary refrigerant, and is provided on the suction side of the secondary compressor 21.

The oil separator 34 is provided at a halfway portion of the discharge flow path 24. The oil separator 34 is configured to separate refrigerating machine oil discharged from the secondary compressor 21 along with the secondary refrigerant from the secondary refrigerant and return the refrigerating machine oil to the secondary compressor 21.

The oil return circuit 40 is provided to connect the oil separator 34 and the suction flow path 23. The oil return circuit 40 includes an oil return flow path 41 as a flow path extending from the oil separator 34 and extending to join a portion between the secondary accumulator 30 and the suction side of the secondary compressor 21 on the suction flow path 23. The oil return flow path 41 has a halfway portion provided with an oil return capillary tube 42 and an oil return on-off valve 44. When the oil return on-off valve 44 is controlled into the opened state, the refrigerating machine oil separated in the oil separator 34 passes the oil return capillary tube 42 on the oil return flow path 41 and is returned to the suction side of the secondary compressor 21. When the secondary compressor 21 is in operation on the secondary refrigerant circuit 10, the oil return on-off valve 44 according to the present embodiment repetitively is kept in the opened state for predetermined time and is kept in the closed state for predetermined time, to control returned quantity of the refrigerating machine oil through the oil return circuit 40. The oil return on-off valve 44 according to the present embodiment is an electromagnetic valve controlled to be opened and closed. The oil return on-off valve 44 may alternatively be an electrically powered expansion valve having a controllable opening degree and not provided with the oil return capillary tube 42. Description is made below to the utilization circuits 13*a*, 13*b*, and 13*c*. As the utilization circuits 13*b* and 13*c* are configured similarly to the utilization circuit 13*a*, elements of the utilization circuits 13*b* and 13*c* will not be described repeatedly, assuming that a subscript "b" or "c" will replace a subscript "a" in reference signs denoting elements of the utilization circuit 13*a*.

The utilization circuit 13*a* principally includes a utilization heat exchanger 52*a* (corresponding to a utilization heat exchanger), a first utilization pipe 57*a*, a second utilization pipe 56*a*, and a utilization expansion valve 51*a* (corresponding to an expansion valve).

The utilization heat exchanger 52*a* is configured to cause heat exchange between a refrigerant and indoor air, and examples thereof include a fin-and-tube heat exchanger constituted by large numbers of heat transfer tubes and fins. The plurality of utilization heat exchangers 52*a*, 52*b*, and 52*c* are connected in parallel to the secondary switching mechanism 22, the suction flow path 23, and the cascade heat exchanger 35.

The second utilization pipe 56*a* has a first end connected to a liquid side (opposite to a gas side) of the utilization heat exchanger 52*a* in the first utilization unit 3*a*. The second utilization pipe 56*a* has a second end connected to the second connecting tube 16*a*. The second utilization pipe 56*a* has a halfway portion provided with the utilization expansion valve 51*a* described above.

The utilization expansion valve 51*a* is an electrically powered expansion valve configured to control a flow rate of the refrigerant flowing in the utilization heat exchanger 52*a*, and having a controllable opening degree. The utilization expansion valve 51*a* is provided on the second utilization pipe 56*a*.

The first utilization pipe 57*a* has a first end connected to the gas side of the utilization heat exchanger 52*a* in the first utilization unit 3*a*. The first utilization pipe 57*a* according to the present embodiment is connected to a portion opposite to the utilization expansion valve 51*a* of the utilization heat exchanger 52*a*. The first utilization pipe 57*a* has a second end connected to the first connecting tube 15*a*.

Description is made below to the branching circuits 14*a*, 14*b*, and 14*c*. As the branching circuits 14*b* and 14*c* are configured similarly to the branching circuit 14*a*, elements of the branching circuits 14*b* and 14*c* will not be described repeatedly, assuming that a subscript "b" or "c" will replace a subscript "a" in reference signs denoting elements of the branching circuit 14*a*.

The branching circuit 14*a* principally includes a junction pipe 62*a*, a first branching pipe 63*a*, a second branching pipe 64*a*, a first control valve 66*a*, a second control valve 67*a*, and a third branching pipe 61*a*.

The junction pipe 62*a* has a first end connected to the first connecting tube 15*a*. The junction pipe 62*a* has a second end branched to be connected with the first branching pipe 63*a* and the second branching pipe 64*a*.

The first branching pipe 63*a* has a portion opposite to the junction pipe 62*a* and connected to the secondary first connection pipe 8. The first branching pipe 63*a* is provided with the first control valve 66*a* configured to be opened and closed. The first control valve 66*a* is exemplified herein by an electrically powered expansion valve having a controllable opening degree, but may alternatively be an electromagnetic valve configured only to be opened and closed.

The second branching pipe 64*a* has a portion opposite to the junction pipe 62*a* and connected to the secondary second connection pipe 9. The second branching pipe 64*a* is provided with the second control valve 67*a* configured to be opened and closed. The second control valve 67*a* is exemplified herein by an electrically powered expansion valve having a controllable opening degree, but may alternatively be an electromagnetic valve configured only to be opened and closed.

The third branching pipe 61*a* has a first end connected to the second connecting tube 16*a*. The third branching pipe 61*a* has a second end connected to the secondary third connection pipe 7.

During cooling operation to be described later, the first branching unit 6*a* brings the first control valve 66*a* and the second control valve 67*a* into the opened state so as to function as follows. The first branching unit 6*a* sends, to the second connecting tube 16*a*, the refrigerant flowing into the third branching pipe 61*a* via the secondary third connection pipe 7. The refrigerant flowing in the second utilization pipe 56*a* in the first utilization unit 3*a* via the second connecting tube 16*a* is sent to the utilization heat exchanger 52*a* in the first utilization unit 3*a* via the utilization expansion valve 51*a*. The refrigerant sent to the utilization heat exchanger 52*a* is evaporated by heat exchange with indoor air, and then flows in the first connecting tube 15*a* via the first utilization pipe 57*a*. The refrigerant having flowed in the first connecting tube 15*a* is sent to the junction pipe 62*a* in the first branching unit 6*a*. The refrigerant having flowed in the junction pipe 62*a* is branched into the first branching pipe 63*a* and the second branching pipe 64*a*. The refrigerant having passed the first control valve 66*a* on the first branching pipe 63*a* is sent to the secondary first connection pipe 8. The refrigerant having passed the second control valve 67*a* on the second branching pipe 64*a* is sent to the secondary second connection pipe 9.

In a case where the first utilization unit 3*a* cools the indoor space during mainly cooling operation and mainly heating operation to be described later, the first branching unit 6*a* brings the first control valve 66*a* into the closed state and the second control valve 67*a* into the opened state so as to function as follows. The first branching unit 6*a* sends, to the second connecting tube 16*a*, the refrigerant flowing into the third branching pipe 61*a* via the secondary third connection pipe 7. The refrigerant flowing in the second utilization pipe 56*a* in the first utilization unit 3*a* via the second connecting tube 16*a* is sent to the utilization heat exchanger 52*a* in the first utilization unit 3*a* via the utilization expansion valve 51*a*. The refrigerant sent to the utilization heat exchanger 52*a* is evaporated by heat exchange with indoor air, and then flows in the first connecting tube 15*a* via the first utilization pipe 57*a*. The refrigerant having flowed in the first connecting tube 15*a* is sent to the junction pipe 62*a* in the first branching unit 6*a*. The refrigerant having flowed in the junction pipe 62*a* flows to the second branching pipe 64*a* and passes the second control valve 67*a* to be subsequently sent to the secondary second connection pipe 9.

During heating operation to be described later, the first branching unit 6*a* brings the second control valve 67*a* into the opened or closed state and brings the first control valve 66*a* into the opened state in accordance with an operation condition so as to function as follows. In the first branching unit 6*a*, the refrigerant flowing into the first branching pipe 63*a* via the secondary first connection pipe 8 passes the first control valve 66*a* to be sent to the junction pipe 62*a*. The refrigerant having flowed in the junction pipe 62*a* flows in the first utilization pipe 57*a* in the utilization unit 3*a* via the first connecting tube 15*a* to be sent to the utilization heat exchanger 52*a*. The refrigerant sent to the utilization heat exchanger 52*a* radiates heat through heat exchange with indoor air, and then passes the utilization expansion valve 51*a* provided on the second utilization pipe 56*a*. The refrigerant having passed the second utilization pipe 56*a* flows in the third branching pipe 61*a* in the first branching unit 6*a* via the second connecting tube 16*a* to be subsequently sent to the secondary third connection pipe 7.

In another case where the first utilization unit 3*a* heats the indoor space during mainly cooling operation and mainly heating operation to be described later, the first branching unit 6*a* brings the second control valve 67*a* into the closed state and brings the first control valve 66*a* into the opened state so as to function as follows. In the first branching unit 6*a*, the refrigerant flowing into the first branching pipe 63*a* via the secondary first connection pipe 8 passes the first control valve 66*a* to be sent to the junction pipe 62*a*. The refrigerant having flowed in the junction pipe 62*a* flows in the first utilization pipe 57*a* in the utilization unit 3*a* via the first connecting tube 15*a* to be sent to the utilization heat exchanger 52*a*. The refrigerant sent to the utilization heat exchanger 52*a* radiates heat through heat exchange with indoor air, and then passes the utilization expansion valve 51*a* provided on the second utilization pipe 56*a*. The refrigerant having passed the second utilization pipe 56*a* flows in the third branching pipe 61*a* in the first branching unit 6*a* via the second connecting tube 16*a* to be subsequently sent to the secondary third connection pipe 7.

The first branching unit 6*a*, as well as the second branching unit 6*b* and the third branching unit 6*c*, similarly have such a function. Accordingly, the first branching unit 6*a*, the second branching unit 6*b*, and the third branching unit 6*c* are configured to individually switchably cause the utilization heat exchangers 52*a*, 52*b*, and 52*c* to function as a refrigerant evaporator or a refrigerant radiator.

(4) Primary Unit

The primary unit 5 is disposed in a space different from a space provided with the utilization units 3*a*, 3*b*, and 3*c* and the branching units 6*a*, 6*b*, and 6*c*, on a roof, or the like.

The primary unit 5 includes part of the primary refrigerant circuit 5*a* described above, a primary fan 75, various sensors, and a primary control unit 70, which are accommodated in a primary casing (not depicted).

The primary unit 5 includes, as the part of the primary refrigerant circuit 5*a*, the primary compressor 71, the primary switching mechanism 72, the primary heat exchanger 74, the primary expansion valve 76, the first liquid shutoff valve 108, and the first gas shutoff valve 109.

The primary fan 75 is provided in the primary unit 5, and is configured to generate an air flow of guiding outdoor air into the primary heat exchanger 74, and exhausting, to outdoors, air obtained after heat exchange with the primary refrigerant flowing in the primary heat exchanger 74. The primary fan 75 is driven by a primary fan motor 75*a*.

The primary unit 5 is provided with the various sensors. Specifically, there are provided an outdoor air temperature sensor 77 configured to detect temperature of outdoor air to be subject to pass the primary heat exchanger 74, a primary discharge pressure sensor 78 configured to detect pressure of the primary refrigerant discharged from the primary compressor 71, a primary suction pressure sensor 79 configured to detect pressure of the primary refrigerant sucked into the primary compressor 71, a primary suction temperature sensor 81 configured to detect temperature of the primary refrigerant sucked into the primary compressor 71, and a primary heat-exchange temperature sensor 82 configured to detect temperature of the refrigerant flowing in the primary heat exchanger 74.

The primary control unit 70 controls behavior of the elements 71 (71*a*), 72, 75 (75*a*), and 76 provided in the primary unit 5. The primary control unit 70 includes a processor such as a CPU or a microcomputer or the like provided to control the primary unit 5 and a memory, so as to transmit and receive control signals and the like to and from a remote controller (not depicted), and to transmit and receive control signals and the like among a heat source control unit 20, branching unit control units 60*a*, 60*b*, and 60*c*, and utilization control units 50*a*, 50*b*, and 50*c*.

(5) Heat Source Unit

The heat source unit 2 is disposed in a space different from the space provided with the utilization units 3*a*, 3*b*, and 3*c* and the branching units 6*a*, 6*b*, and 6*c*, on a roof, or the like.

The heat source unit 2 is connected to the branching units 6*a*, 6*b*, and 6*c* via the connection pipes 7, 8, and 9, to constitute part of the secondary refrigerant circuit 10. The heat source unit 2 is connected with the primary unit 5 via the primary first connection pipe 111 and the primary second connection pipe 112, to constitute part of the primary refrigerant circuit 5*a*.

The heat source unit 2 principally includes the heat source circuit 12 described above, various sensors, the heat source control unit 20, the second liquid shutoff valve 106 constituting part of the primary refrigerant circuit 5*a*, the first connecting pipe 115, the second connecting pipe 113, and the second gas shutoff valve 107, which are accommodated in the heat source casing (not depicted).

The heat source unit 2 is provided with a secondary suction pressure sensor 37 configured to detect pressure of the secondary refrigerant on the suction side of the secondary compressor 21, a secondary discharge pressure sensor 38 configured to detect pressure of the secondary refrigerant on the discharge side of the secondary compressor 21, a secondary discharge temperature sensor 39 configured to detect temperature of the secondary refrigerant on the discharge side of the secondary compressor 21, a secondary suction temperature sensor 88 configured to detect temperature of the secondary refrigerant on the suction side of the secondary compressor 21, a secondary cascade temperature sensor 83 configured to detect temperature of the secondary refrigerant flowing between the secondary flow path 35*a* of the cascade heat exchanger 35 and the heat source expansion valve 36, a receiver outlet temperature sensor 84 configured to detect temperature of the secondary refrigerant flowing between the secondary receiver 45 and the subcooling heat exchanger 47, a bypass circuit temperature sensor 85 configured to detect temperature of the secondary refrigerant flowing downstream of the bypass expansion valve 46*a* on the bypass circuit 46, a subcooling outlet temperature sensor 86 configured to detect temperature of the secondary refrigerant flowing between the subcooling heat exchanger 47 and the third shutoff valve 31, and a subcooling circuit temperature sensor 87 configured to detect temperature of the secondary refrigerant flowing at an outlet of the subcooling heat exchanger 47 on the subcooling circuit 48.

The heat source control unit 20 controls behavior of the elements 21 (21*a*), 22, 36, 44, 46*a*, and 48*a* provided in the heat source unit 2. The heat source control unit 20 includes a processor such as a CPU or a microcomputer or the like provided to control the heat source unit 2 and a memory, so as to transmit and receive control signals and the like among the primary control unit 70 in the primary unit 5, the utilization control units 50*a*, 50*b*, and 50*c* in the utilization units 3*a*, 3*b*, and 3*c*, and the branching unit control units 60*a*, 60*b*, and 60*c*.

(6) Utilization Unit

The utilization units 3*a*, 3*b*, and 3*c* are installed by being embedded in or being suspended from a ceiling in an indoor space of a building or the like, or by being hung on a wall surface in the indoor space, or the like.

The utilization units 3*a*, 3*b*, and 3*c* are connected to the heat source unit 2 via the connection pipes 7, 8, and 9.

The utilization units 3*a*, 3*b*, and 3*c* respectively include the utilization circuits 13*a*, 13*b*, and 13*c* constituting part of the secondary refrigerant circuit 10.

The utilization units 3*a*, 3*b*, and 3*c* will be described hereinafter in terms of their configurations. The second utilization unit 3*b* and the third utilization unit 3*c* are configured similarly to the first utilization unit 3*a*. The configuration of only the first utilization unit 3*a* will thus be described herein. As to the configuration of each of the second utilization unit 3*b* and the third utilization unit 3*c*, elements will be denoted by reference signs obtained by replacing a subscript "a" in reference signs of elements of the first utilization unit 3*a* with a subscript "b" or "c", and these elements will not be described repeatedly.

The first utilization unit 3*a* principally includes the utilization circuit 13*a* described above, an indoor fan 53*a*, the utilization control unit 50*a*, and various sensors. The indoor fan 53*a* includes an indoor fan motor 54*a*.

The indoor fan 53*a* generates an air flow of sucking indoor air into the unit and supplying the indoor space with supply air obtained after heat exchange with the refrigerant flowing in the utilization heat exchanger 52*a*. The indoor fan 53*a* is driven by the indoor fan motor 54*a*.

The utilization unit 3*a* is provided with a liquid-side temperature sensor 58*a* configured to detect temperature of a refrigerant on the liquid side of the utilization heat exchanger 52*a*. The utilization unit 3*a* is further provided with an indoor temperature sensor 55*a* configured to detect indoor temperature as temperature of air introduced from the indoor space and to be subject to pass the utilization heat exchanger 52*a*.

The utilization control unit 50*a* controls behavior of the elements 51*a* and 53*a* (54*a*) of the utilization unit 3*a*. The utilization control unit 50*a* includes a processor such as a CPU or a microcomputer or the like provided to control the utilization unit 3*a* and a memory, so as to transmit and receive control signals and the like to and from the remote controller (not depicted), and to transmit and receive control signals and the like among the heat source control unit 20, the branching unit control units 60*a*, 60*b*, and 60*c*, and the primary control unit 70 in the primary unit 5.

The second utilization unit 3*b* includes the utilization circuit 13*b*, an indoor fan 53*b*, the utilization control unit 50*b*, and an indoor fan motor 54*b*. The third utilization unit 3*c* includes the utilization circuit 13*c*, an indoor fan 53*c*, the utilization control unit 50*c*, and an indoor fan motor 54*c*.

(7) Branching Unit

The branching units 6*a*, 6*b*, and 6*c* are installed in a space behind the ceiling of the indoor space of the building or the like.

Each of the branching units 6*a*, 6*b*, and 6*c* is connected to a corresponding one of the utilization units 3*a*, 3*b*, and 3*c* one by one. The branching units 6*a*, 6*b*, and 6*c* are connected to the heat source unit 2 via the connection pipes 7, 8, and 9.

The branching units 6*a*, 6*b*, and 6*c* will be described next in terms of their configurations. The second branching unit 6*b* and the third branching unit 6*c* are configured similarly to the first branching unit 6*a*. The configuration of only the first branching unit 6*a* will thus be described herein. As to the configuration of each of the second branching unit 6*b* and the third branching unit 6*c*, elements will be denoted by reference signs obtained by replacing a subscript "a" in reference signs of elements of the first branching unit 6*a* with a subscript "b" or "c", and these elements will not be described repeatedly.

The first branching unit 6*a* principally includes the branching circuit 14*a* described above, and the branching unit control unit 60*a*.

The branching unit control unit 60*a* controls behavior of the elements 66*a* and 67*a* of the branching unit 6*a*. The branching unit control unit 60*a* includes a processor such as a CPU or a microcomputer or the like provided to control the branching unit 6*a* and a memory, so as to transmit and receive control signals and the like to and from the remote controller (not depicted), and to transmit and receive control signals and the like among the heat source control unit 20, the utilization units 3*a*, 3*b*, and 3*c*, and the primary control unit 70 in the primary unit 5.

The second branching unit 6*b* includes the branching circuit 14*b*, and the branching unit control unit 60*b*. The third branching unit 6*c* includes the branching circuit 14*c*, and the branching unit control unit 60*c*.

(8) Control Unit

In the refrigeration cycle system 1, the heat source control unit 20, the utilization control units 50*a*, 50*b*, and 50*c*, the branching unit control units 60*a*, 60*b*, and 60*c*, and the primary control unit 70 described above are connected wiredly or wirelessly to be mutually communicable so as to constitute a control unit 80. The control unit 80 accordingly controls behavior of the elements 21 (21*a*), 22, 36, 44, 46*a*, 48*a*, 51*a*, 51*b*, 51*c*, 53*a*, 53*b*, 53*c* (54*a*, 54*b*, 54*c*), 66*a*, 66*b*, 66*c*, 67*a*, 67*b*, 67*c*, 71 (71*a*), 72, 75 (75*a*), and 76 in accordance with detection information of the various sensors 37, 38, 39, 83, 84, 85, 86, 87, 88, 77, 78, 79, 81, 82, 58*a*, 58*b*, 58*c*, and the like, command information received from the remote controller (not depicted), and the like.

(9) Behavior of Refrigeration Cycle System

Behavior of the refrigeration cycle system 1 will be described next with reference to FIG. 3 to FIG. 6.

Refrigeration cycle operation of the refrigeration cycle system 1 can be divided principally into cooling operation, heating operation, mainly cooling operation, and mainly heating operation. During heating operation and mainly heating operation, heat storing operation and defrosting operation to be described later are executed if a predetermined condition is satisfied.

Herein, cooling operation corresponds to refrigeration cycle operation in a case where there are only utilization units each of which operates with the utilization heat exchanger functioning as a refrigerant evaporator, and the cascade heat exchanger 35 functions as a radiator for the secondary refrigerant with respect to evaporation loads of all the utilization units.

Heating operation corresponds to refrigeration cycle operation in a case where there are only utilization units each of which operates with the utilization heat exchanger functioning as a refrigerant radiator, and the cascade heat exchanger 35 functions as an evaporator for the secondary refrigerant with respect to radiation loads of all the utilization units.

During mainly cooling operation, there coexist a utilization unit operating with the utilization heat exchanger functioning as a refrigerant evaporator and a utilization unit operating with the utilization heat exchanger functioning as a refrigerant radiator. Mainly cooling operation corresponds to refrigeration cycle operation in a case where the cascade heat exchanger 35 functions as a radiator for the secondary refrigerant with respect to evaporation loads of all the utilization units principally occupying heat loads of all the utilization units.

During mainly heating operation, there coexist a utilization unit operating with the utilization heat exchanger functioning as a refrigerant evaporator, and a utilization unit operating with the utilization heat exchanger functioning as a refrigerant radiator. Mainly heating operation corresponds to refrigeration cycle operation in a case where the cascade heat exchanger 35 functions as an evaporator for the secondary refrigerant with respect to radiation loads of all the utilization units principally occupying heat loads of all the utilization units.

Behavior of the refrigeration cycle system 1 including these types of refrigeration cycle operation is executed by the control unit 80.

(9-1) Cooling Operation

Figure 3:
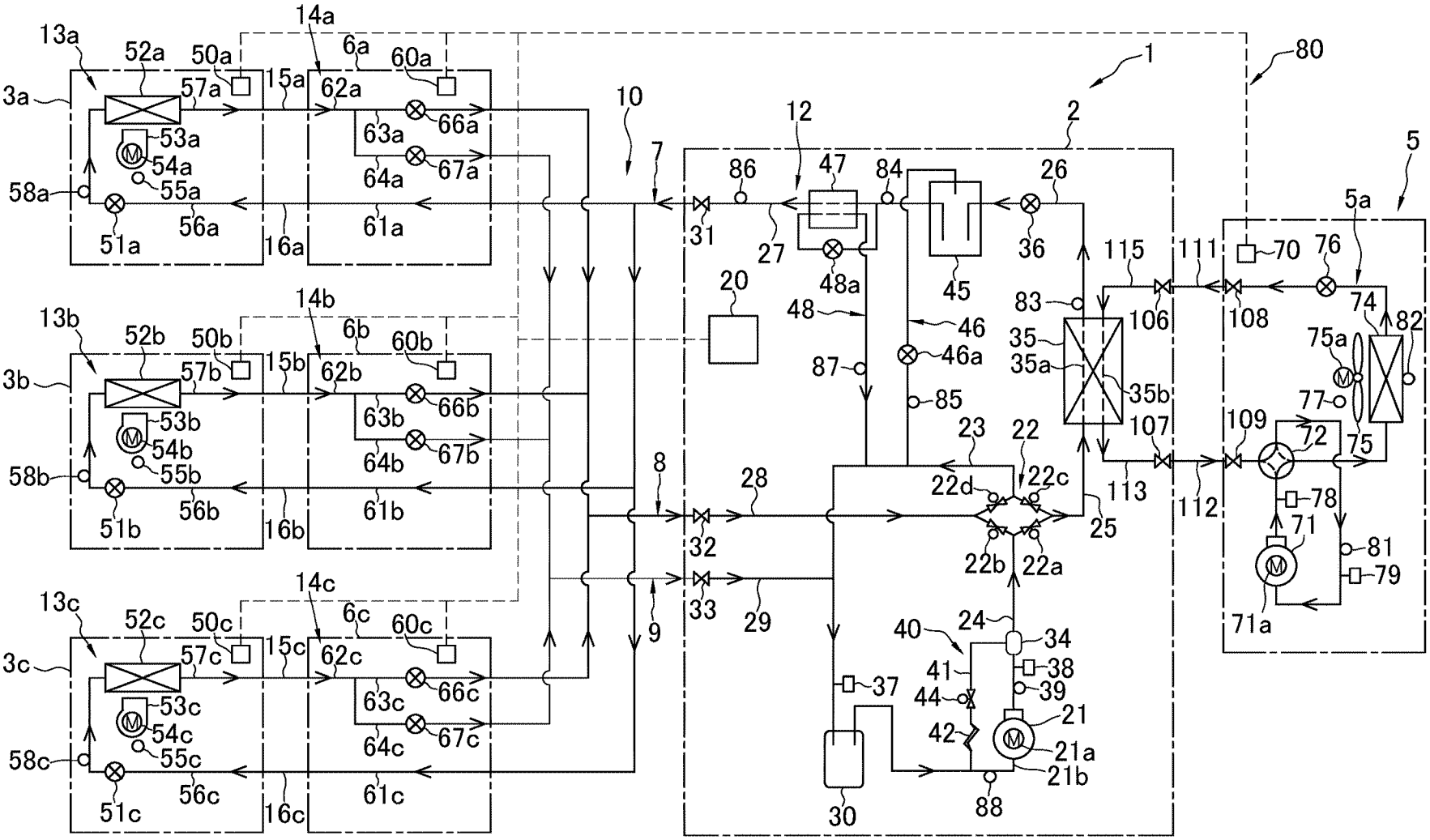
FIG. 3 is a view indicating behavior (a refrigerant flow) during cooling operation of the refrigeration cycle system.

During cooling operation, for example, each of the utilization heat exchangers 52*a*, 52*b*, and 52*c* in the utilization units 3*a*, 3*b*, and 3*c* functions as a refrigerant evaporator, and the cascade heat exchanger 35 functions as a radiator for the secondary refrigerant. During such cooling operation, the primary refrigerant circuit 5*a* and the secondary refrigerant circuit 10 in the refrigeration cycle system 1 are configured as depicted in FIG. 3. FIG. 3 includes arrows provided to the primary refrigerant circuit 5*a* and arrows provided to the secondary refrigerant circuit 10, which indicate refrigerant flows during cooling operation.

Specifically, in the primary unit 5, the primary switching mechanism 72 is switched into the fifth connection state to cause the cascade heat exchanger 35 to function as an evaporator for the primary refrigerant. The fifth connection state of the primary switching mechanism 72 is depicted by solid lines in the primary switching mechanism 72 in FIG. 3. Accordingly in the primary unit 5, the primary refrigerant discharged from the primary compressor 71 passes the primary switching mechanism 72 and exchanges heat with outdoor air supplied from the primary fan 75 in the primary heat exchanger 74 to be condensed. The primary refrigerant condensed in the primary heat exchanger 74 is decompressed at the primary expansion valve 76, then flows in the primary flow path 35*b* of the cascade heat exchanger 35 to be evaporated, and is sucked into the primary compressor 71 via the primary switching mechanism 72.

In the heat source unit 2, the secondary switching mechanism 22 is switched into the first connection state as well as the fourth connection state to cause the cascade heat exchanger 35 to function as a radiator for the secondary refrigerant. In the first connection state of the secondary switching mechanism 22, the first switching valve 22*a* is in the opened state and the third switching valve 22*c* is in the closed state. In the fourth connection state of the secondary switching mechanism 22, the fourth switching valve 22*d* is in the opened state and the second switching valve 22*b* is in the closed state. The heat source expansion valve 36 is controlled in opening degree. In the first to third utilization units 3*a*, 3*b*, and 3*c*, the first control valves 66*a*, 66*b*, and 66*c* and the second control valves 67*a*, 67*b*, and 67*c* are controlled into the opened state. Accordingly, each of the utilization heat exchangers 52*a*, 52*b*, and 52*c* in the utilization units 3*a*, 3*b*, and 3*c* functions as a refrigerant evaporator. All the utilization heat exchangers 52*a*, 52*b*, and 52*c* in the utilization units 3*a*, 3*b*, and 3*c* and the suction side of the secondary compressor 21 in the heat source unit 2 are connected via the first utilization pipes 57*a*, 57*b*, and 57*c*, the first connecting tubes 15*a*, 15*b*, and 15*c*, the junction pipes 62*a*, 62*b*, and 62*c*, the first branching pipes 63*a*, 63*b*, and 63*c*, the second branching pipes 64*a*, 64*b*, and 64*c*, the first connection pipe 8, and the second connection pipe 9. The subcooling expansion valve 48*a* is controlled in opening degree such that the secondary refrigerant flowing at the outlet of the subcooling heat exchanger 47 toward the third connection pipe 7 has a degree of subcooling at a predetermined value. The bypass expansion valve 46*a* is controlled into the closed state. In the utilization units 3*a*, 3*b*, and 3*c*, the utilization expansion valves 51*a*, 51*b*, and 51*c* are each controlled in opening degree.

In the secondary refrigerant circuit 10 in this state, a secondary high-pressure refrigerant compressed in and discharged from the secondary compressor 21 is sent to the secondary flow path 35*a* of the cascade heat exchanger 35 via the secondary switching mechanism 22. The secondary high-pressure refrigerant flowing in the secondary flow path 35*a* of the cascade heat exchanger 35 radiates heat, and the primary refrigerant flowing in the primary flow path 35*b* of the cascade heat exchanger 35 is evaporated. The secondary refrigerant having radiated heat in the cascade heat exchanger 35 passes the heat source expansion valve 36 controlled in opening degree, and then flows into the receiver 45. Part of the refrigerant having flowed out of the receiver 45 is branched into the subcooling circuit 48, is decompressed at the subcooling expansion valve 48*a*, and then joins the suction flow path 23. In the subcooling heat exchanger 47, part of the remaining refrigerant having flowed out of the receiver 45 is cooled by the refrigerant flowing in the subcooling circuit 48, and is then sent to the third connection pipe 7 via the third shutoff valve 31.

The refrigerant sent to the third connection pipe 7 is branched into three portions to pass the third branching pipes 61*a*, 61*b*, and 61*c* of the first to third branching units 6*a*, 6*b*, and 6*c*. Thereafter, the refrigerant having flowed in the second connecting tubes 16*a*, 16*b*, and 16*c* is sent to the second utilization pipes 56*a*, 56*b*, and 56*c* of the first to third utilization units 3*a*, 3*b*, and 3*c*. The refrigerant sent to the second utilization pipes 56*a*, 56*b*, and 56*c* is sent to the utilization expansion valves 51*a*, 51*b*, and 51*c* in the utilization units 3*a*, 3*b*, and 3*c*.

The refrigerant having passed the utilization expansion valves 51*a*, 51*b*, and 51*c* each controlled in opening degree exchanges heat with indoor air supplied by the indoor fans 53*a*, 53*b*, and 53*c* in the utilization heat exchangers 52*a*, 52*b*, and 52*c*. The refrigerant flowing in the utilization heat exchangers 52*a*, 52*b*, and 52*c* is thus evaporated into a low-pressure gas refrigerant. Indoor air is cooled and is supplied into the indoor space. The indoor space is thus cooled. The low-pressure gas refrigerant evaporated in the utilization heat exchangers 52*a*, 52*b*, and 52*c* flows in the first utilization pipes 57*a*, 57*b*, and 57*c*, flows in the first connecting tubes 15*a*, 15*b*, and 15*c*, and is then sent to the junction pipes 62*a*, 62*b*, and 62*c* of the first to third branching units 6*a*, 6*b*, and 6*c*.

The low-pressure gas refrigerant sent to the junction pipes 62*a*, 62*b*, and 62*c* is branched into the first branching pipes 63*a*, 63*b*, and 63*c*, and the second branching pipes 64*a*, 64*b*, and 64*c* and flows. The refrigerant having passed the first control valves 66*a*, 66*b*, and 66*c* on the first branching pipes 63*a*, 63*b*, and 63*c* is sent to the first connection pipe 8. The refrigerant having passed the second control valves 67*a*, 67*b*, and 67*c* on the second branching pipes 64*a*, 64*b*, and 64*c* is sent to the second connection pipe 9.

The low-pressure gas refrigerant sent to the first connection pipe 8 and the second connection pipe 9 is returned to the suction side of the secondary compressor 21 via the first shutoff valve 32, the second shutoff valve 33, the first heat source pipe 28, the second heat source pipe 29, the secondary switching mechanism 22, the suction flow path 23, and the accumulator 30.

Behavior during cooling operation is executed in this manner.

(9-2) Heating Operation

Figure 4:
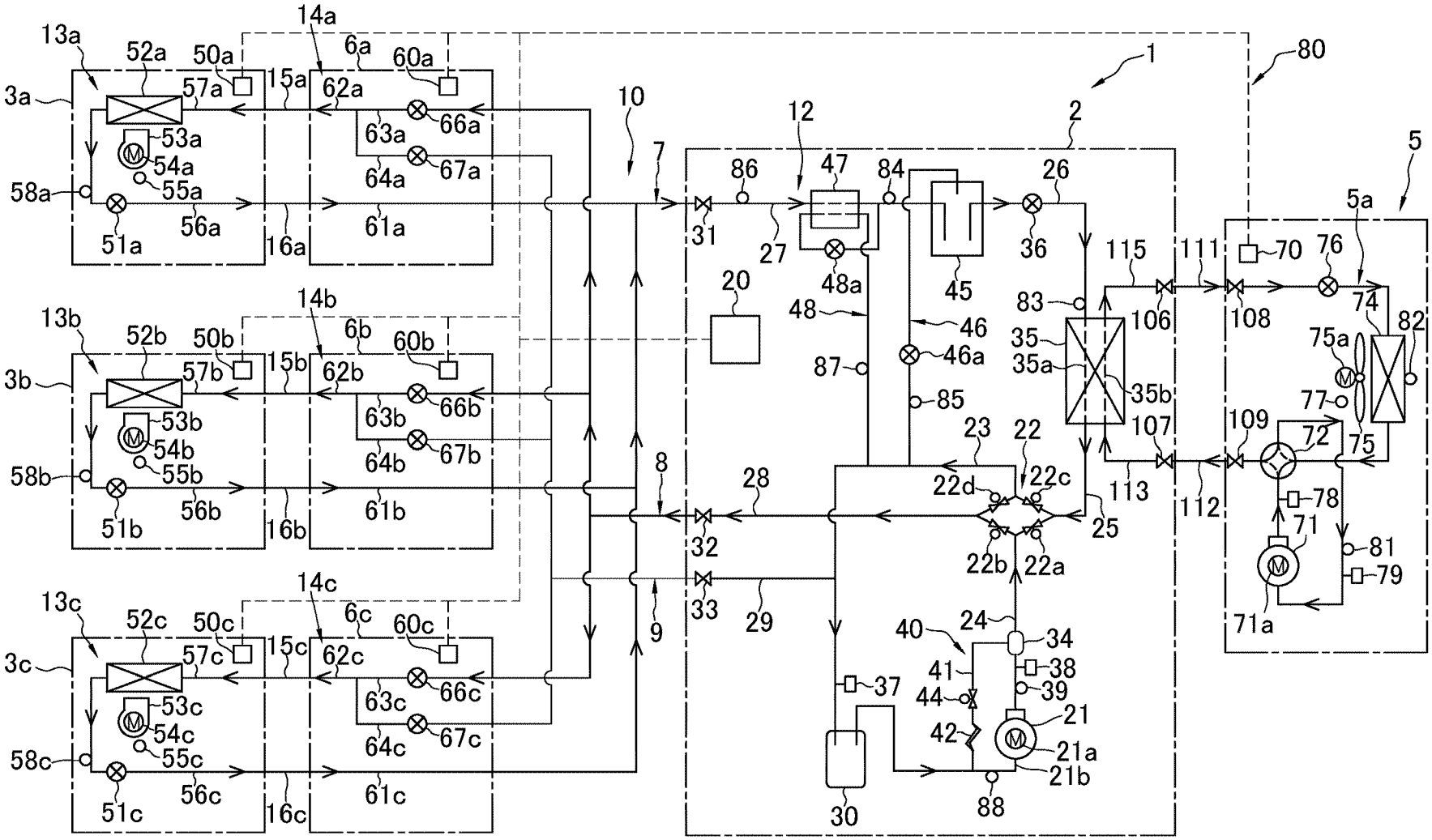
FIG. 4 is a view indicating behavior (a refrigerant flow) during heating operation of the refrigeration cycle system.

During heating operation, each of the utilization heat exchangers 52*a*, 52*b*, and 52*c* in the utilization units 3*a*, 3*b*, and 3*c* functions as a refrigerant radiator. Furthermore, during heating operation, the cascade heat exchanger 35 functions as an evaporator for the secondary refrigerant. During heating operation, the primary refrigerant circuit 5*a* and the secondary refrigerant circuit 10 in the refrigeration cycle system 1 are configured as depicted in FIG. 4. FIG. 4 includes arrows provided to the primary refrigerant circuit 5*a* and arrows provided to the secondary refrigerant circuit 10, which indicate refrigerant flows during heating operation.

Specifically, in the primary unit 5, the primary switching mechanism 72 is switched into a sixth connection state to cause the cascade heat exchanger 35 to function as a radiator for the primary refrigerant. The sixth connection state of the primary switching mechanism 72 corresponds to a connection state depicted by broken lines in the primary switching mechanism 72 in FIG. 4. Accordingly in the primary unit 5, the primary refrigerant discharged from the primary compressor 71 passes the primary switching mechanism 72 and flows in the primary flow path 35*b* of the cascade heat exchanger 35 to be condensed. The primary refrigerant condensed in the cascade heat exchanger 35 is decompressed at the primary expansion valve 76, then exchanges heat with outdoor air supplied from the primary fan 75 in the primary heat exchanger 74 to be evaporated, and is sucked into the primary compressor 71 via the primary switching mechanism 72.

In the heat source unit 2, the secondary switching mechanism 22 is switched into the second connection state as well as the third connection state. The cascade heat exchanger 35 thus functions as an evaporator for the secondary refrigerant. In the second connection state of the secondary switching mechanism 22, the first switching valve 22*a* is in the closed state and the third switching valve 22*c* is in the opened state. In the third connection state of the secondary switching mechanism 22, the second switching valve 22*b* is in the opened state and the fourth switching valve 22*d* is in the closed state. The heat source expansion valve 36 is controlled in opening degree. In the first to third branching units 6*a*, 6*b*, and 6*c*, the first control valves 66*a*, 66*b*, and 66*c* are controlled into the opened state, and the second control valves 67*a*, 67*b*, and 67*c* are controlled into the closed state. Accordingly, each of the utilization heat exchangers 52*a*, 52*b*, and 52*c* in the utilization units 3*a*, 3*b*, and 3*c* functions as a refrigerant radiator. The utilization heat exchangers 52*a*, 52*b*, and 52*c* in the utilization units 3*a*, 3*b*, and 3*c* and the discharge side of the secondary compressor 21 in the heat source unit 2 are connected via the discharge flow path 24, the first heat source pipe 28, the first connection pipe 8, the first branching pipes 63*a*, 63*b*, and 63*c*, the junction pipes 62*a*, 62*b*, and 62*c*, the first connecting tubes 15*a*, 15*b*, and 15*c*, and the first utilization pipes 57*a*, 57*b*, and 57*c*. The subcooling expansion valve 48*a* and the bypass expansion valve 46*a* are controlled into the closed state. In the utilization units 3*a*, 3*b*, and 3*c*, the utilization expansion valves 51*a*, 51*b*, and 51*c* are each controlled in opening degree.

In the secondary refrigerant circuit 10 in this state, a high-pressure refrigerant compressed in and discharged from the secondary compressor 21 is sent to the first heat source pipe 28 via the second switching valve 22*b* controlled into the opened state in the secondary switching mechanism 22. The refrigerant sent to the first heat source pipe 28 is sent to the first connection pipe 8 via the first shutoff valve 32.

The high-pressure refrigerant sent to the first connection pipe 8 is branched into three portions to be sent to the first branching pipes 63*a*, 63*b*, and 63*c* in the utilization units 3*a*, 3*b*, and 3*c* in operation. The high-pressure refrigerant sent to the first branching pipes 63*a*, 63*b*, and 63*c* passes the first control valves 66*a*, 66*b*, and 66*c*, and flows in the junction pipes 62*a*, 62*b*, and 62*c*. The refrigerant having flowed in the first connecting tubes 15*a*, 15*b*, and 15*c* and the first utilization pipes 57*a*, 57*b*, and 57*c* is then sent to the utilization heat exchangers 52*a*, 52*b*, and 52*c*.

The high-pressure refrigerant sent to the utilization heat exchangers 52*a*, 52*b*, and 52*c* exchanges heat with indoor air supplied by the indoor fans 53*a*, 53*b*, and 53*c* in the utilization heat exchangers 52*a*, 52*b*, and 52*c*. The refrigerant flowing in the utilization heat exchangers 52*a*, 52*b*, and 52*c* thus radiates heat. Indoor air is heated and is supplied into the indoor space. The indoor space is thus heated. The refrigerant having radiated heat in the utilization heat exchangers 52*a*, 52*b*, and 52*c* flows in the second utilization pipes 56*a*, 56*b*, and 56*c* and passes the utilization expansion valves 51*a*, 51*b*, and 51*c* each controlled in opening degree. Thereafter, the refrigerant having flowed in the second connecting tubes 16*a*, 16*b*, and 16*c* flows in the third branching pipes 61*a*, 61*b*, and 61*c* of the branching units 6*a*, 6*b*, and 6*c*.

The refrigerant sent to the third branching pipes 61*a*, 61*b*, and 61*c* is sent to the third connection pipe 7 to join.

The refrigerant sent to the third connection pipe 7 is sent to the heat source expansion valve 36 via the third shutoff valve 31. The refrigerant sent to the heat source expansion valve 36 is controlled in flow rate at the heat source expansion valve 36 and is then sent to the cascade heat exchanger 35. In the cascade heat exchanger 35, the secondary refrigerant flowing in the secondary flow path 35*a* is evaporated into a low-pressure gas refrigerant and is sent to the secondary switching mechanism 22, and the primary refrigerant flowing in the primary flow path 35*b* of the cascade heat exchanger 35 is condensed. The secondary low-pressure gas refrigerant sent to the secondary switching mechanism 22 is returned to the suction side of the secondary compressor 21 via the suction flow path 23 and the accumulator 30.

Behavior during heating operation is executed in this manner.

(9-3) Mainly Cooling Operation

Figure 5:
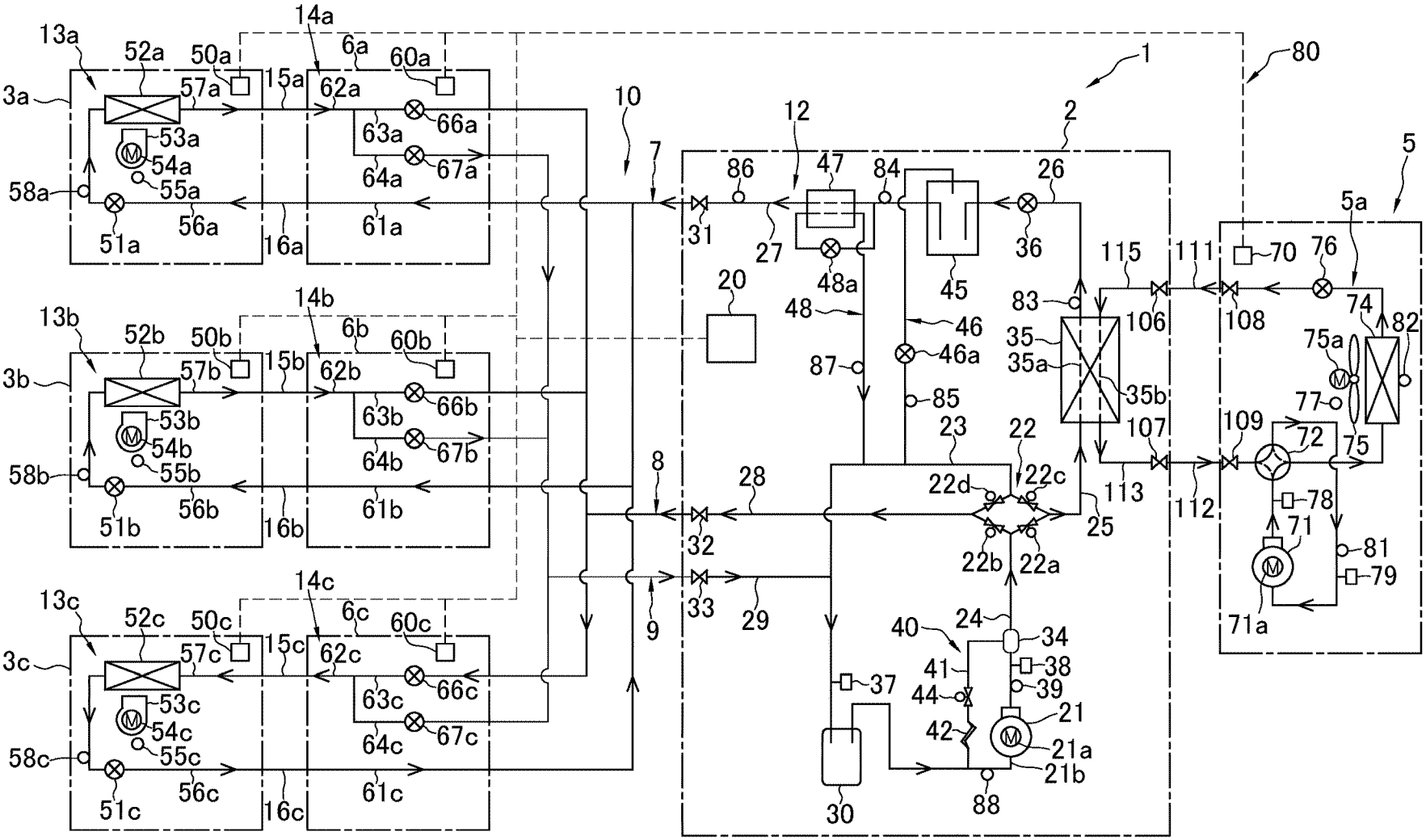
FIG. 5 is a view indicating behavior (a refrigerant flow) during simultaneous cooling and heating operation (mainly cooling) of the refrigeration cycle system.

During mainly cooling operation, for example, the utilization heat exchangers 52*a* and 52*b* in the utilization units 3*a* and 3*b* each function as a refrigerant evaporator, and the utilization heat exchanger 52*c* in the utilization unit 3*c* functions as a refrigerant radiator. During mainly cooling operation, the cascade heat exchanger 35 functions as a radiator for the secondary refrigerant. During mainly cooling operation, the primary refrigerant circuit 5*a* and the secondary refrigerant circuit 10 in the refrigeration cycle system 1 are configured as depicted in FIG. 5. FIG. 5 includes arrows provided to the primary refrigerant circuit 5*a* and arrows provided to the secondary refrigerant circuit 10, which indicate refrigerant flows during mainly cooling operation.

Specifically, in the primary unit 5, the primary switching mechanism 72 is switched into the fifth connection state (the state depicted by solid lines in the primary switching mechanism 72 in FIG. 5) to cause the cascade heat exchanger 35 to function as an evaporator for the primary refrigerant. Accordingly in the primary unit 5, the primary refrigerant discharged from the primary compressor 71 passes the primary switching mechanism 72 and exchanges heat with outdoor air supplied from the primary fan 75 in the primary heat exchanger 74 to be condensed. The primary refrigerant condensed in the primary heat exchanger 74 is decompressed at the primary expansion valve 76, then flows in the primary flow path 35*b* of the cascade heat exchanger 35 to be evaporated, and is sucked into the primary compressor 71 via the primary switching mechanism 72.

In the heat source unit 2, the secondary switching mechanism 22 is switched into the first connection state (the first switching valve 22*a* is in the opened state and the third switching valve 22*c* is in the closed state) as well as the third connection state (the second switching valve 22*b* is in the opened state and the fourth switching valve 22*d* is in the closed state) to cause the cascade heat exchanger 35 to function as a radiator for the secondary refrigerant. The heat source expansion valve 36 is controlled in opening degree. In the first to third branching units 6*a*, 6*b*, and 6*c*, the first control valve 66*c* and the second control valves 67*a* and 67*b* are controlled into the opened state, and the first control valves 66*a* and 66*b* and the second control valve 67*c* are controlled into the closed state. Accordingly, the utilization heat exchangers 52*a* and 52*b* in the utilization units 3*a* and 3*b* each function as a refrigerant evaporator, and the utilization heat exchanger 52*c* in the utilization unit 3*c* functions as a refrigerant radiator. The utilization heat exchangers 52*a* and 52*b* in the utilization units 3*a* and 3*b* and the suction side of the secondary compressor 21 in the heat source unit 2 are connected via the second connection pipe 9, and the utilization heat exchanger 52*c* in the utilization unit 3*c* and the discharge side of the secondary compressor 21 in the heat source unit 2 are connected via the first connection pipe 8. The subcooling expansion valve 48*a* is controlled in opening degree such that the secondary refrigerant flowing at the outlet of the subcooling heat exchanger 47 toward the third connection pipe 7 has a degree of subcooling at a predetermined value. The bypass expansion valve 46*a* is controlled into the closed state. In the utilization units 3*a*, 3*b*, and 3*c*, the utilization expansion valves 51*a*, 51*b*, and 51*c* are each controlled in opening degree.

In the secondary refrigerant circuit 10 in this state, part of the secondary high-pressure refrigerant compressed in and discharged from the secondary compressor 21 is sent to the first connection pipe 8 via the secondary switching mechanism 22, the first heat source pipe 28, and the first shutoff valve 32, and the remaining is sent to the secondary flow path 35*a* of the cascade heat exchanger 35 via the secondary switching mechanism 22 and the third heat source pipe 25.

The high-pressure refrigerant sent to the first connection pipe 8 is sent to the first branching pipe 63*c*. The high-pressure refrigerant sent to the first branching pipe 63*c* is sent to the utilization heat exchanger 52*c* in the utilization unit 3*c* via the first control valve 66*c* and the junction pipe 62*c*.

The high-pressure refrigerant sent to the utilization heat exchanger 52*c* exchanges heat with indoor air supplied by the indoor fan 53*c* in the utilization heat exchanger 52*c*. The refrigerant flowing in the utilization heat exchanger 52*c* thus radiates heat. Indoor air is heated and is supplied into the indoor space, and the utilization unit 3*c* executes heating operation. The refrigerant having radiated heat in the utilization heat exchanger 52*c* flows in the second utilization pipe 56*c* and is controlled in flow rate at the utilization expansion valve 51*c*. The refrigerant having flowed in the second connecting tube 16*c* is sent to the third branching pipe 61*c* in the branching unit 6*c*.

The refrigerant sent to the third branching pipe 61*c* is sent to the third connection pipe 7.

The high-pressure refrigerant sent to the secondary flow path 35*a* of the cascade heat exchanger 35 exchanges heat with the primary refrigerant flowing in the primary flow path 35*b* in the cascade heat exchanger 35 to radiate heat. The secondary refrigerant having radiated heat in the cascade heat exchanger 35 is controlled in flow rate at the heat source expansion valve 36 and then flows into the receiver 45. Part of the refrigerant having flowed out of the receiver 45 is branched into the subcooling circuit 48, is decompressed at the subcooling expansion valve 48*a*, and then joins the suction flow path 23. In the subcooling heat exchanger 47, part of the remaining refrigerant having flowed out of the receiver 45 is cooled by the refrigerant flowing in the subcooling circuit 48, is then sent to the third connection pipe 7 via the third shutoff valve 31, and joins the refrigerant having radiated heat in the utilization heat exchanger 52*c*.

The refrigerant having joined in the third connection pipe 7 is branched into two portions to be sent to the third branching pipes 61*a* and 61*b* of the branching units 6*a* and 6*b*. Thereafter, the refrigerant having flowed in the second connecting tubes 16*a* and 16*b* is sent to the second utilization pipes 56*a* and 56*b* of the first and second utilization units 3*a* and 3*b*. The refrigerant flowing in the second utilization pipes 56*a* and 56*b* passes the utilization expansion valves 51*a* and 51*b* in the utilization units 3*a* and 3*b*.

The refrigerant having passed the utilization expansion valves 51*a* and 51*b* each controlled in opening degree exchanges heat with indoor air supplied by the indoor fans 53*a* and 53*b* in the utilization heat exchangers 52*a* and 52*b*. The refrigerant flowing in the utilization heat exchangers 52*a* and 52*b* is thus evaporated into a low-pressure gas refrigerant. Indoor air is cooled and is supplied into the indoor space. The indoor space is thus cooled. The low-pressure gas refrigerant evaporated in the utilization heat exchangers 52*a* and 52*b* is sent to the junction pipes 62*a* and 62*b* of the first and second branching units 6*a* and 6*b*.

The low-pressure gas refrigerant sent to the junction pipes 62*a* and 62*b* is sent to the second connection pipe 9 via the second control valves 67*a* and 67*b* and the second branching pipes 64*a* and 64*b*, to join.

The low-pressure gas refrigerant sent to the second connection pipe 9 is returned to the suction side of the secondary compressor 21 via the second shutoff valve 33, the second heat source pipe 29, the suction flow path 23, and the accumulator 30.

Behavior during mainly cooling operation is executed in this manner.

(9-4) Mainly Heating Operation

Figure 6:
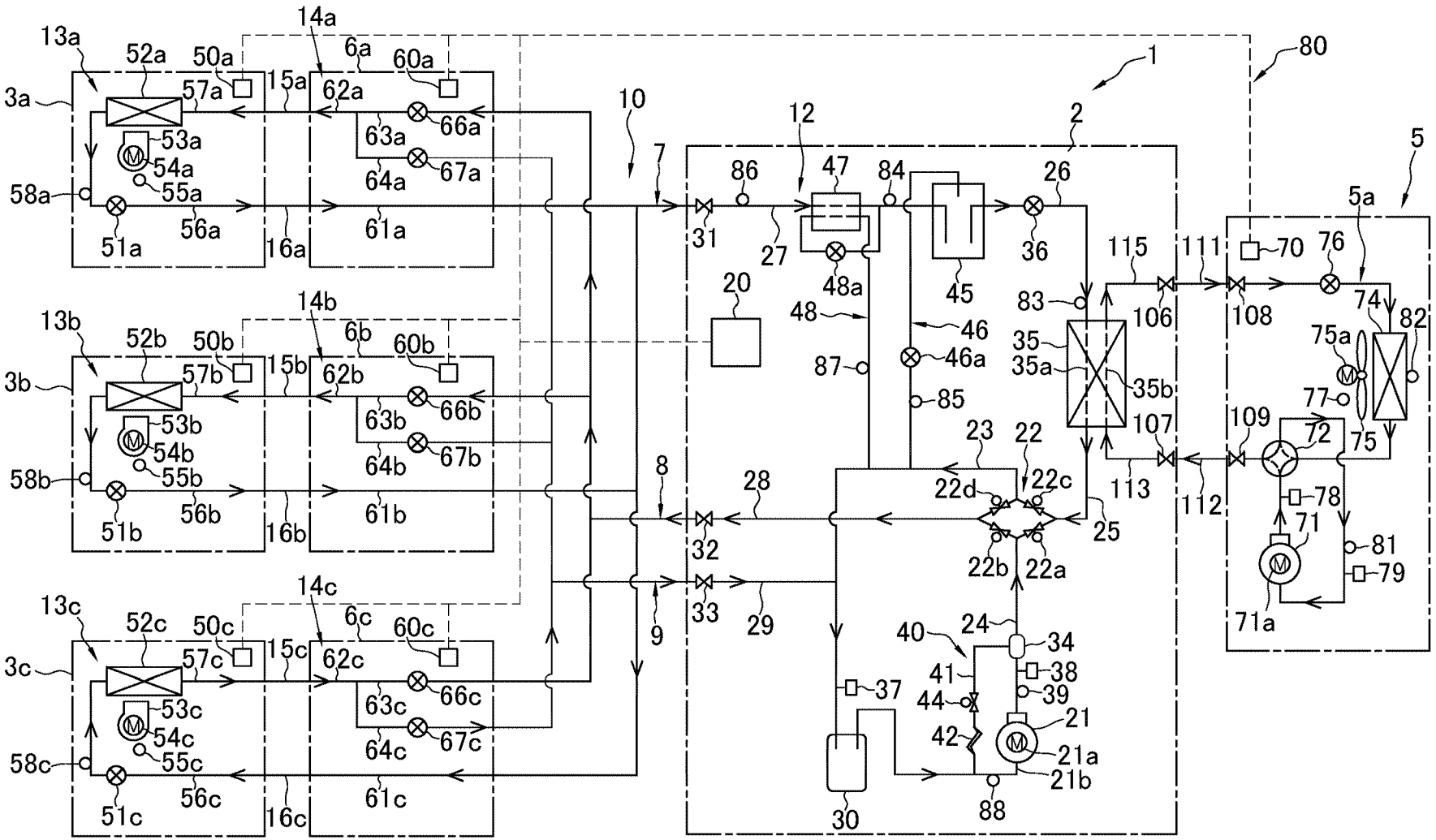
FIG. 6 is a view indicating behavior (a refrigerant flow) during simultaneous cooling and heating operation (mainly heating) of the refrigeration cycle system.

During mainly heating operation, for example, the utilization heat exchangers 52*a* and 52*b* in the utilization units 3*a* and 3*b* each function as a refrigerant radiator, and the utilization heat exchanger 52*c* functions as a refrigerant evaporator. During mainly heating operation, the cascade heat exchanger 35 functions as an evaporator for the secondary refrigerant. During mainly heating operation, the primary refrigerant circuit 5*a* and the secondary refrigerant circuit 10 in the refrigeration cycle system 1 are configured as depicted in FIG. 6. FIG. 6 includes arrows provided to the primary refrigerant circuit 5*a* and arrows provided to the secondary refrigerant circuit 10, which indicate refrigerant flows during mainly heating operation.

Specifically, in the primary unit 5, the primary switching mechanism 72 is switched into a sixth connection state to cause the cascade heat exchanger 35 to function as a radiator for the primary refrigerant. The sixth connection state of the primary switching mechanism 72 corresponds to a connection state depicted by broken lines in the primary switching mechanism 72 in FIG. 6. Accordingly in the primary unit 5, the primary refrigerant discharged from the primary compressor 71 passes the primary switching mechanism 72 and flows in the primary flow path 35*b* of the cascade heat exchanger 35 to be condensed. The primary refrigerant condensed in the cascade heat exchanger 35 is decompressed at the primary expansion valve 76, then exchanges heat with outdoor air supplied from the primary fan 75 in the primary heat exchanger 74 to be evaporated, and is sucked into the primary compressor 71 via the primary switching mechanism 72.

In the heat source unit 2, the secondary switching mechanism 22 is switched into the second connection state as well as the third connection state. In the second connection state of the secondary switching mechanism 22, the first switching valve 22*a* is in the closed state and the third switching valve 22*c* is in the opened state. In the third connection state of the secondary switching mechanism 22, the second switching valve 22*b* is in the opened state and the fourth switching valve 22*d* is in the closed state. The cascade heat exchanger 35 thus functions as an evaporator for the secondary refrigerant. The heat source expansion valve 36 is controlled in opening degree. In the first to third branching units 6*a*, 6*b*, and 6*c*, the first control valves 66*a* and 66*b* and the second control valve 67*c* are controlled into the opened state, and the first control valve 66*c* and the second control valves 67*a* and 67*b* are controlled into the closed state. Accordingly, the utilization heat exchangers 52*a* and 52*b* in the utilization units 3*a* and 3*b* each function as a refrigerant radiator, and the utilization heat exchanger 52*c* in the utilization unit 3*c* functions as a refrigerant evaporator. The utilization heat exchanger 52*c* in the utilization unit 3*c* and the suction side of the secondary compressor 21 in the heat source unit 2 are connected via the first utilization pipe 57*c*, the first connecting tube 15*c*, the junction pipe 62*c*, the second branching pipe 64*c*, and the second connection pipe 9. The utilization heat exchangers 52*a* and 52*b* in the utilization units 3*a* and 3*b* and the discharge side of the secondary compressor 21 in the heat source unit 2 are connected via the discharge flow path 24, the first heat source pipe 28, the first connection pipe 8, the first branching pipes 63*a* and 63*b*, the junction pipes 62*a* and 62*b*, the first connecting tubes 15*a* and 15*b*, and the first utilization pipes 57*a* and 57*b*. The subcooling expansion valve 48*a* and the bypass expansion valve 46*a* are controlled into the closed state. In the utilization units 3*a*, 3*b*, and 3*c*, the utilization expansion valves 51*a*, 51*b*, and 51*c* are each controlled in opening degree.

In the secondary refrigerant circuit 10 in this state, a secondary high-pressure refrigerant compressed in and discharged from the secondary compressor 21 is sent to the first connection pipe 8 via the secondary switching mechanism 22, the first heat source pipe 28, and the first shutoff valve 32.

The high-pressure refrigerant sent to the first connection pipe 8 is branched into two portions to be sent to the first branching pipes 63*a* and 63*b* of the first branching unit 6*a* and the second branching unit 6*b* respectively connected to the first utilization unit 3*a* and the second utilization unit 3*b* in operation. The high-pressure refrigerant sent to the first branching pipes 63*a* and 63*b* is sent to the utilization heat exchangers 52*a* and 52*b* in the first utilization unit 3*a* and the second utilization unit 3*b* via the first control valves 66*a* and 66*b*, the junction pipes 62*a* and 62*b*, and the first connecting tubes 15*a* and 15*b*.

The high-pressure refrigerant sent to the utilization heat exchangers 52*a* and 52*b* exchanges heat with indoor air supplied by the indoor fans 53*a* and 53*b* in the utilization heat exchangers 52*a* and 52*b*. The refrigerant flowing in the utilization heat exchangers 52*a* and 52*b* thus radiates heat. Indoor air is heated and is supplied into the indoor space. The indoor space is thus heated. The refrigerant having radiated heat in the utilization heat exchangers 52*a* and 52*b* flows in the second utilization pipes 56*a* and 56*b*, and passes the utilization expansion valves 51*a* and 51*b* each controlled in opening degree. Thereafter, the refrigerant having flowed in the second connecting tubes 16*a* and 16*b* is sent to the third connection pipe 7 via the third branching pipes 61*a* and 61*b* of the branching units 6*a* and 6*b*.

Part of the refrigerant sent to the third connection pipe 7 is sent to the third branching pipe 61*c* of the branching unit 6*c*, and the remaining is sent to the heat source expansion valve 36 via the third shutoff valve 31.

The refrigerant sent to the third branching pipe 61*c* flows in the second utilization pipe 56*c* of the utilization unit 3*c* via the second connecting tube 16*c*, and is sent to the utilization expansion valve 51*c*.

The refrigerant having passed the utilization expansion valve 51*c* controlled in opening degree exchanges heat with indoor air supplied by the indoor fan 53*c* in the utilization heat exchanger 52*c*. The refrigerant flowing in the utilization heat exchanger 52*c* is thus evaporated into a low-pressure gas refrigerant. Indoor air is cooled and is supplied into the indoor space. The indoor space is thus cooled. The low-pressure gas refrigerant evaporated in the utilization heat exchanger 52*c* passes the first utilization pipe 57*c* and the first connecting tube 15*c* to be sent to the junction pipe 62*c*.

The low-pressure gas refrigerant sent to the junction pipe 62*c* is sent to the second connection pipe 9 via the second control valve 67*c* and the second branching pipe 64*c*.

The low-pressure gas refrigerant sent to the second connection pipe 9 is returned to the suction side of the secondary compressor 21 via the second shutoff valve 33, the second heat source pipe 29, the suction flow path 23, and the accumulator 30.

The refrigerant sent to the heat source expansion valve 36 passes the heat source expansion valve 36 controlled in opening degree, and then exchanges heat with the primary refrigerant flowing in the primary flow path 35*b* in the secondary flow path 35*a* of the cascade heat exchanger 35. The refrigerant flowing in the secondary flow path 35*a* of the cascade heat exchanger 35 is evaporated into a low-pressure gas refrigerant and is sent to the secondary switching mechanism 22. The low-pressure gas refrigerant sent to the secondary switching mechanism 22 joins the low-pressure gas refrigerant evaporated in the utilization heat exchanger 52*c* on the suction flow path 23. The refrigerant thus joined is returned to the suction side of the secondary compressor 21 via the accumulator 30.

Behavior during mainly heating operation is executed in this manner.

(10) Heat Storing Operation and Defrosting Operation

Figure 7:
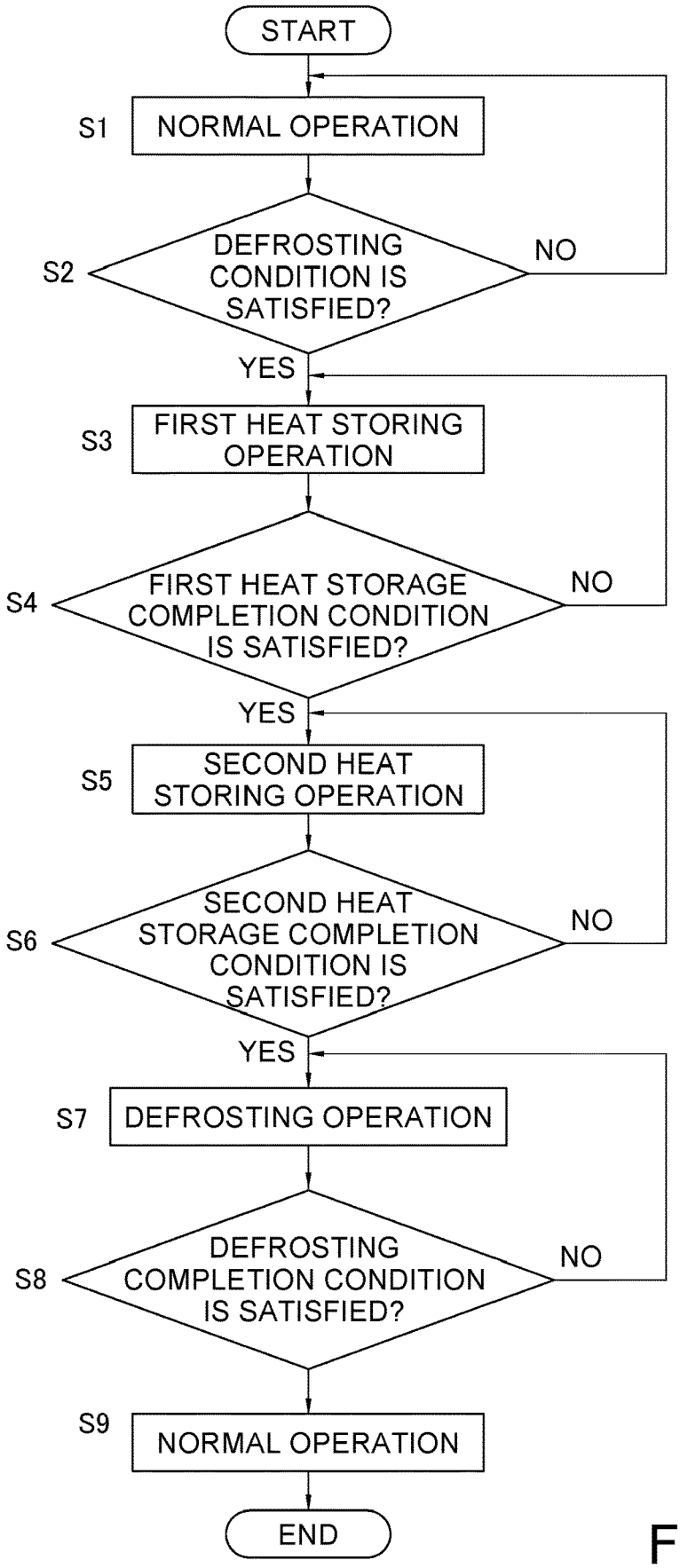
FIG. 7 is an activation control flowchart of the refrigeration cycle system.

In the refrigeration cycle system 1, heat storing operation and defrosting operation are executed when the predetermined condition is satisfied during normal operation of heating operation or mainly heating operation. Heat storing operation and defrosting operation will be described hereinafter with reference to a flowchart in FIG. 7.

Described herein is a process flow from execution of heat storing operation and defrosting operation subsequent to heating operation or mainly heating operation, and then returning to heating operation or mainly heating operation.

In step S1, the control unit 80 controls various devices such that the refrigeration cycle system 1 executes normal operation of heating operation or mainly heating operation.

In step S2, the control unit 80 determines whether or not a predetermined defrosting condition is satisfied regarding adhesion of frost to the primary heat exchanger 74. The defrosting condition is not limited, and determination can be made in accordance with at least one of conditions such as outdoor air temperature is equal to or less than a predetermined value, predetermined time has elapsed from completion of last defrosting operation, temperature of the primary heat exchanger 74 is equal to or less than a predetermined value, and evaporation pressure or evaporation temperature of the primary refrigerant is equal to or less than a predetermined value. The flow transitions to step S3 if the defrosting condition is satisfied. Step S2 is repeated if the defrosting condition is not satisfied.

In step S3, the control unit 80 starts first heat storing operation as the heat storing operation.

During first heat storing operation, the control unit 80 executes various control as follows. The refrigerant flow during first heat storing operation is similar to the refrigerant flow during heating operation depicted in FIG. 4.

As to the primary refrigerant circuit 5*a*, the control unit 80 keeps the primary switching mechanism 72 in the connection state of normal operation, keeps the primary fan 75 in an operating state, and continuously drives the primary compressor 71. The primary refrigerant thus flows in the order of the primary compressor 71, the cascade heat exchanger 35, the primary expansion valve 76, and the primary heat exchanger 74. The control unit 80 further controls a valve opening degree of the primary expansion valve 76 such that the refrigerant sucked into the primary compressor 71 has a degree of superheating at a predetermined value. Alternatively, the control unit 80 may control to increase a drive frequency of the primary compressor 71 so as to be higher than the drive frequency during normal operation, or may control the drive frequency of the primary compressor 71 to a predetermined maximum frequency.

As to the secondary refrigerant circuit 10, the control unit 80 stops the indoor fans 53*a*, 53*b*, and 53*c*. Upon transition from heating operation to first heat storing operation, the control unit 80 keeps the connection state of the secondary switching mechanism 22, keeps the utilization expansion valves 51*a*, 51*b*, and 51*c* and the first control valves 66*a*, 66*b*, and 66*c* in the opened state, and keeps the second control valves 67*a*, 67*b*, and 67*c*, the subcooling expansion valve 48*a*, and the bypass expansion valve 46*a* in the closed state. Upon transition from mainly heating operation to first heat storing operation, the control unit 80 keeps the connection state of the secondary switching mechanism 22, controls the utilization expansion valves 51*a*, 51*b*, and 51*c* and the first control valves 66*a*, 66*b*, and 66*c* into the opened state, and controls the second control valves 67*a*, 67*b*, and 67*c*, the subcooling expansion valve 48*a*, and the bypass expansion valve 46*a* into the closed state. The secondary refrigerant thus flows in the order of the secondary compressor 21, the utilization heat exchangers 52*a*, 52*b*, and 52*c*, the utilization expansion valves 51*a*, 51*b*, and 51*c*, and the cascade heat exchanger 35. The control unit 80 controls a valve opening degree of the heat source expansion valve 36 such that the refrigerant sucked into the secondary compressor 21 has a degree of superheating at a predetermined value. Alternatively, the secondary compressor 21 may keep driven, or may be controlled to have a higher drive frequency in comparison to normal operation.

In step S4, the control unit 80 determines whether or not a first heat storage completion condition is satisfied. The first heat storage completion condition is not limited in this case, and determination can be made in accordance with at least one of conditions such as predetermined time has elapsed from the start of first heat storing operation, the cascade heat exchanger 35 has temperature equal to or more than a predetermined value, the secondary refrigerant discharged from the secondary compressor 21 has pressure equal to or more than a predetermined value, the secondary refrigerant discharged from the secondary compressor 21 has temperature equal to or more than a predetermined value, and the secondary refrigerant at a predetermined site having a flow of a liquid refrigerant on the secondary refrigerant circuit 10 has temperature equal to or more than a predetermined value. The flow transitions to step S5 if the first heat storage completion condition is satisfied. Step S3 is repeated if the first heat storage completion condition is not satisfied.

In step S5, the control unit 80 ends first heat storing operation, switches the secondary switching mechanism 22 into the first connection state as well as the fourth connection state after executing pressure equalizing behavior at the secondary refrigerant circuit 10, controls the utilization expansion valves 51*a*, 51*b*, and 51*c* into the closed state, and starts second heat storing operation as heat storing operation. Alternatively, the first control valves 66*a*, 66*b*, and 66*c* and the second control valves 67*a*, 67*b*, and 67*c* may be controlled into the closed state in this case.

Figure 8:
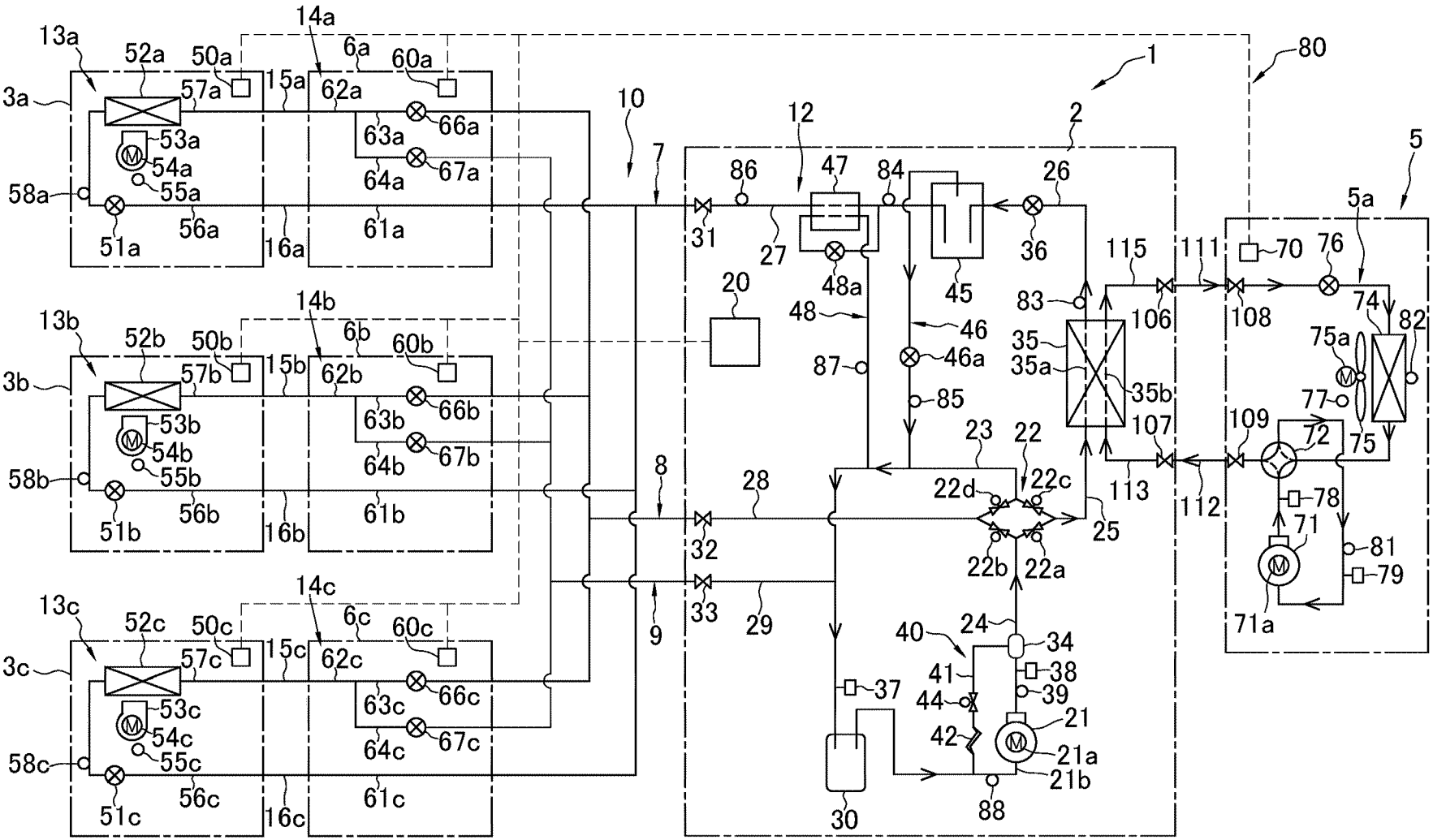
FIG. 8 is a view indicating behavior (a refrigerant flow) during second heat storing operation of the refrigeration cycle system.

During second heat storing operation, the control unit 80 executes various control as follows. FIG. 8 indicates a refrigerant flow during second heat storing operation.

As to the primary refrigerant circuit 5*a*, the control unit 80 keeps operation similar to first heat storing operation.

As to the secondary refrigerant circuit 10, the control unit 80 switches the secondary switching mechanism 22 into the first connection state as well as the fourth connection state with the indoor fans 53*a*, 53*b*, and 53*c* being kept stopped, and drives the secondary compressor 21 while controlling the utilization expansion valves 51*a*, 51*b*, and 51*c*, the first control valves 66*a*, 66*b*, and 66*c*, the second control valves 67*a*, 67*b*, and 67*c*, and the subcooling expansion valve 48*a* into the closed state and controlling the bypass expansion valve 46*a* into the opened state. The secondary refrigerant thus flows in the order of the secondary compressor 21, the cascade heat exchanger 35, the receiver 45, the bypass circuit 46, and the bypass expansion valve 46*a*. The heat source expansion valve 36 is controlled into a fully opened state. The control unit 80 controls the drive frequency such that a high pressure refrigerant and a low pressure refrigerant at the secondary refrigerant circuit 10 have differential pressure secured to be equal to or more than a predetermined value in the secondary compressor 21. The control unit 80 controls a valve opening degree of the bypass expansion valve 46*a* in accordance with temperature of the cascade heat exchanger 35 and a degree of superheating of the refrigerant discharged from the secondary compressor 21. Specifically, the control unit 80 controls to increase the valve opening degree such that the secondary refrigerant has a secured flow in the cascade heat exchanger 35 and the cascade heat exchanger 35 has temperature kept equal to or more than a predetermined value, and controls to decrease the valve opening degree such that the refrigerant discharged from the secondary compressor 21 has a degree of superheating kept equal to or more than a predetermined value to prevent a wet state of the secondary refrigerant sucked into the secondary compressor 21, so as to control the valve opening degree of the bypass expansion valve 46*a*.

In step S6, the control unit 80 determines whether or not a second heat storage completion condition is satisfied. The second heat storage completion condition is not limited in this case, and determination can be made in accordance with at least one of conditions such as predetermined time has elapsed from the start of second heat storing operation, the secondary refrigerant discharged from the secondary compressor 21 has pressure equal to or more than a predetermined value, the secondary refrigerant discharged from the secondary compressor 21 has temperature equal to or more than a predetermined value, the primary refrigerant discharged from the primary compressor 71 has pressure equal to or more than a predetermined value, the primary refrigerant discharged from the primary compressor 71 has temperature equal to or more than a predetermined value, and the cascade heat exchanger 35 has temperature equal to or more than a predetermined value. The control unit 80 may alternatively determine that the second heat storage completion condition is satisfied if the primary control unit 70 configured to control the primary refrigerant circuit 5*a* determines completion of preparation for starting defrosting operation at the primary refrigerant circuit 5*a*. The flow transitions to step S7 if the second heat storage completion condition is satisfied. Step S5 is repeated if the second heat storage completion condition is not satisfied.

In step S7, the control unit 80 ends second heat storing operation and starts defrosting operation.

Figure 9:
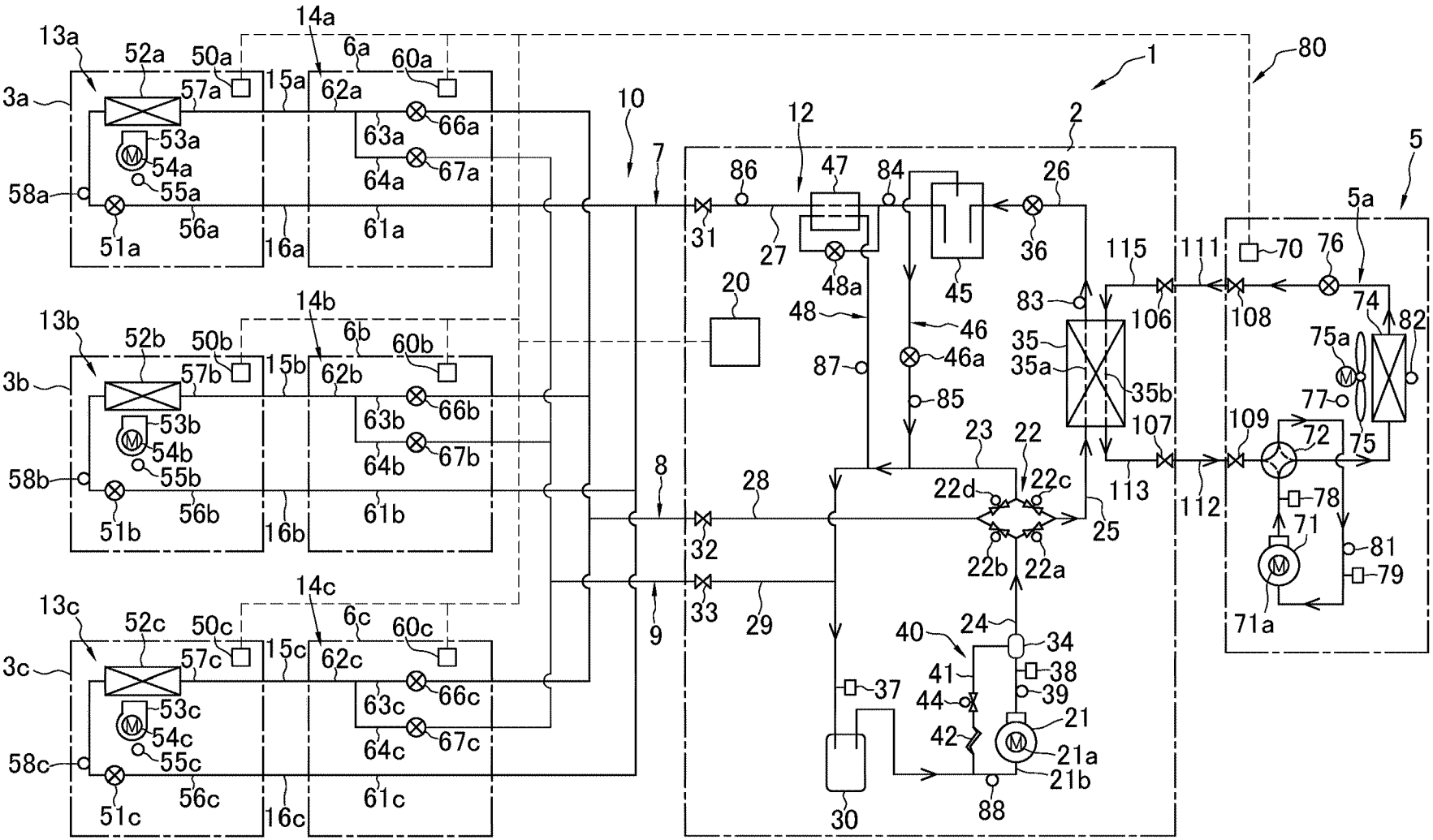
FIG. 9 is a view indicating behavior (a refrigerant flow) during defrosting operation of the refrigeration cycle system.

During defrosting operation, the control unit 80 executes various control as follows. FIG. 9 indicates a refrigerant flow during defrosting operation.

As to the primary refrigerant circuit 5*a*, the control unit 80 switches the primary switching mechanism 72 into the fifth connection state after executing pressure equalizing behavior at the primary refrigerant circuit 5*a*, and drives the primary compressor 71 while keeping the primary fan 75 stopped. The primary refrigerant thus flows in the order of the primary compressor 71, the primary heat exchanger 74, the primary expansion valve 76, and the cascade heat exchanger 35. The control unit 80 controls the valve opening degree of the primary expansion valve 76 such that the degree of superheating of the refrigerant sucked into the primary compressor 71 is kept at the predetermined value. Alternatively, the control unit 80 may control to increase a drive frequency of the primary compressor 71 so as to be higher than the drive frequency during normal operation, or may control the drive frequency of the primary compressor 71 to a predetermined maximum frequency.

As to the secondary refrigerant circuit 10, the control unit 80 keeps control for second heat storing operation.

In step S8, the control unit 80 determines whether or not a defrosting completion condition is satisfied. The defrosting completion condition is not limited, and determination can be made in accordance with at least one of conditions such as predetermined time has elapsed from the start of defrosting operation, the primary heat exchanger 74 has temperature equal to or more than a predetermined value, and condensation pressure or condensation temperature of the primary refrigerant is equal to or more than a predetermined value. The flow transitions to step S9 if the defrosting completion condition is satisfied. Step S7 is repeated if the defrosting completion condition is not satisfied.

In step S9, the control unit 80 controls various devices such that the refrigeration cycle system 1 returns to heating operation or mainly heating operation.

(11) Characteristics of Embodiment

The refrigeration cycle system 1 according to the present embodiment executes first heat storing operation and second heat storing operation as heat storing operation before starting defrosting operation.

During first heat storing operation, the secondary compressor 21 is driven with the indoor fans 53*a*, 53*b*, and 53*c* being stopped in the secondary refrigerant circuit 10. This inhibits heat release from the secondary refrigerant in the utilization heat exchangers 52*a*, 52*b*, and 52*c*, and enables heat storage in the secondary refrigerant circuit 10. In particular, the indoor fans 53*a*, 53*b*, and 53*c* are stopped, so that the secondary refrigerant having passed the utilization heat exchangers 52*a*, 52*b*, and 52*c*, with heat release being inhibited, reaches the secondary flow path 35*a* of the cascade heat exchanger 35 to enable heat storage in the cascade heat exchanger 35.

Furthermore, during second heat storing operation, the secondary refrigerant circuit 10 has circulation such that the bypass expansion valve 46*a* is opened to cause the secondary refrigerant to flow to the bypass circuit 46, with the utilization expansion valves 51*a*, 51*b*, and 51*c* being closed to stop supply of the secondary refrigerant to the utilization circuits 13*a*, 13*b*, and 13*c*. Accordingly, the utilization heat exchangers 52*a*, 52*b*, and 52*c* have inhibited temperature decrease while a high-temperature high-pressure refrigerant discharged from the secondary compressor 21 is supplied to the secondary flow path 35*a* of the cascade heat exchanger 35 to cause the cascade heat exchanger 35 to store heat, so as to inhibit deterioration of a utilization environment.

In the primary refrigerant circuit 5*a* during first heat storing operation and second heat storing operation, the high-temperature high-pressure refrigerant discharged from the primary compressor 71 is sent to the primary flow path 35*b* of the cascade heat exchanger 35. This also promotes heat storage at the cascade heat exchanger 35.

The refrigeration cycle system 1 according to the present embodiment accordingly achieves sufficient heat storage for melting frost at the primary heat exchanger 74 during defrosting operation prior to execution of the defrosting operation.

In the secondary refrigerant circuit 10 during defrosting operation, the cascade heat exchanger 35 can be supplied with heat by sending the high-temperature high-pressure refrigerant discharged from the secondary compressor 21 to the secondary flow path 35*a* of the cascade heat exchanger 35 while stopping supply of the secondary refrigerant to the utilization circuits 13*a*, 13*b*, and 13*c*. In the primary refrigerant circuit 5*a*, the primary refrigerant flowing in the primary flow path 35*b* of the cascade heat exchanger 35 can be provided with heat supplied from the secondary refrigerant to the cascade heat exchanger 35, and the primary compressor 71 can further pressurize the primary refrigerant thus provided with the heat in order to melt frost at the primary heat exchanger 74 by means of the refrigerant brought into the high-temperature high-pressure state. Frost at the primary heat exchanger 74 can thus be molten efficiently. This shortens time of deterioration of the utilization environment due to execution of defrosting operation.

During second heat storing operation and defrosting operation described above, the secondary refrigerant flows to the bypass circuit 46 extending from the gas phase region in the receiver 45 on the secondary refrigerant circuit 10. This allows the secondary refrigerant flowing in the bypass circuit 46 to principally become a gas refrigerant, so as to easily inhibit the refrigerant sucked into the secondary compressor 21 from coming into the wet state.

During second heat storing operation and defrosting operation described above, the valve opening degree of the bypass expansion valve 46*a* is controlled such that the cascade heat exchanger 35 has temperature kept equal to or more than a predetermined value and the refrigerant discharged from the secondary compressor 21 has a degree of superheating kept equal to or more than a predetermined value. Assuming that the secondary refrigerant has a stopped flow in the secondary flow path 35*a* of the cascade heat exchanger 35, the primary refrigerant evaporates at the primary flow path 35*b* of the cascade heat exchanger 35, so that heat keeps released from the secondary refrigerant stopped in the secondary flow path 35*a*. Accordingly, the secondary refrigerant is decreased in temperature in the secondary flow path 35*a*, and the cascade heat exchanger 35 is also decreased in temperature, to decrease heat used for melting frost at the primary heat exchanger 74 during defrosting operation. In contrast, the valve opening degree of the bypass expansion valve 46*a* is controlled such that temperature of the cascade heat exchanger 35 is kept equal to or more than a predetermined value, so as to inhibit the secondary refrigerant from being stopped in the secondary flow path 35*a* and secure sufficient heat for defrosting operation. Furthermore, the valve opening degree of the bypass expansion valve 46*a* is controlled to inhibit the wet state of the secondary refrigerant sucked into the secondary compressor 21. This sufficiently secures heat for defrosting operation and inhibits liquid compression in the secondary compressor 21.

In the refrigeration cycle system 1 according to the present embodiment, adoption of carbon dioxide as a refrigerant in the secondary refrigerant circuit 10 decreases the global warming potential (GWP). Even if the refrigerant containing no chlorofluorocarbon leaks on the utilization side, there is no outflow of chlorofluorocarbon on the utilization side.

The refrigeration cycle system 1 according to the present embodiment adopts the binary refrigeration cycle, to exhibit sufficient capacity at the secondary refrigerant circuit 10.

(12) Other Embodiments

(12-1) Other Embodiment A

The above embodiment exemplifies execution of first heat storing operation and second heat storing operation as heat storing operation before starting defrosting operation.

For example, heat storing operation executed before the start of defrosting operation may alternatively include only first heat storing operation or only second heat storing operation.

When only first heat storing operation is executed as heat storing operation, defrosting operation according to the above embodiment may start upon satisfaction of the first heat storage completion condition. Alternatively, control of defrosting operation may start at the primary refrigerant circuit 5*a* after first heat storing operation ends and control of defrosting operation starts at the secondary refrigerant circuit 10. In other words, control of defrosting operation at the primary refrigerant circuit 5*a* may not start before control of defrosting operation at the secondary refrigerant circuit 10. In this case, in an exemplary case where the first heat storage completion condition is satisfied, the secondary switching mechanism 22 may be switched into the first connection state as well as the fourth connection state in the secondary refrigerant circuit 10, and the primary compressor 71 on the primary refrigerant circuit 5*a* may be stopped until the primary control unit 70 determines that preparation for the start of defrosting operation completes in the primary refrigerant circuit 5*a*. When the primary control unit 70 thereafter determines that preparation for the start of defrosting operation completes in the primary refrigerant circuit 5*a*, the secondary compressor 21 on the secondary refrigerant circuit 10 may be activated and the primary compressor 71 on the primary refrigerant circuit 5*a* may subsequently be activated. Pressure equalizing behavior at the primary refrigerant circuit 5*a* and switching the primary switching mechanism 72 into the fifth connection state may be executed after satisfaction of the first heat storage completion condition, or upon determination by the primary control unit 70 that preparation for the start of defrosting operation is completed in the primary refrigerant circuit 5*a*. The above control allows the primary flow path 35*b* of the cascade heat exchanger 35 to function as an evaporator for the primary refrigerant and allows the secondary flow path 35*a* to function as an evaporator for the secondary refrigerant, to avoid a situation where the primary refrigerant flowing in the primary flow path 35*b* becomes less likely to gain heat from the secondary refrigerant flowing in the secondary flow path 35*a*.

When only second heat storing operation is executed as heat storing operation, second heat storing operation starts upon satisfaction of the defrosting condition, and defrosting operation thereafter starts upon satisfaction of the second heat storage completion condition. Alternatively, upon satisfaction of the second heat storage completion condition, similarly to the above case, control of defrosting operation may start in the primary refrigerant circuit 5*a* after control of defrosting operation initially starts in the secondary refrigerant circuit 10. In an exemplary case where the second heat storage completion condition is satisfied, with the secondary switching mechanism 22 being kept in its connection state in the secondary refrigerant circuit 10, the primary compressor 71 on the primary refrigerant circuit 5*a* may be stopped until the primary control unit 70 determines that preparation for the start of defrosting operation completes in the primary refrigerant circuit 5*a*. When the primary control unit 70 thereafter determines that preparation for the start of defrosting operation completes in the primary refrigerant circuit 5*a*, the secondary compressor 21 on the secondary refrigerant circuit 10 may be activated and the primary compressor 71 on the primary refrigerant circuit 5*a* may subsequently be activated. Pressure equalizing behavior at the primary refrigerant circuit 5*a* and switching the primary switching mechanism 72 into the fifth connection state may be executed after satisfaction of the second heat storage completion condition, or upon determination by the primary control unit 70 that preparation for the start of defrosting operation completes in the primary refrigerant circuit 5*a*. Similarly to the above case, it is possible to avoid the situation where the primary refrigerant flowing in the primary flow path 35*b* is less likely to gain heat from the secondary refrigerant flowing in the secondary flow path 35*a*.

(12-2) Other Embodiment B

The above embodiment exemplifies the case where a refrigerant flows in the bypass circuit 46 during second heat storing operation and defrosting operation.

The bypass circuit 46 extends from the gas phase region in the receiver 45. It is thus possible to send a gas-phase refrigerant toward the suction side of the secondary compressor 21 until the receiver 45 is filled with a refrigerant in the liquid state.

In an exemplary case where second heat storing operation or defrosting operation is continuously executed to satisfy a full liquid condition as to the receiver 45 being filled with a liquid refrigerant, the subcooling expansion valve 48*a* may be opened instead of opening the bypass expansion valve 46*a* or along with opening the bypass expansion valve 46*a*, so as to cause the refrigerant to flow also in the subcooling circuit 48.

The full liquid condition as to the receiver 45 being filled with a liquid refrigerant may be exemplarily determined in accordance with the degree of superheating of the refrigerant flowing downstream of the bypass expansion valve 46*a* in the bypass circuit 46. The degree of superheating may be obtained from temperature detected by the bypass circuit temperature sensor 85, pressure detected by the secondary suction pressure sensor 37, and the like.

(12-3) Other Embodiment C

The above embodiment exemplifies the case where the indoor fans 53*a*, 53*b*, and 53*c* are stopped during first heat storing operation.

However, first heat storing operation is not limited to control to stop the indoor fans 53*a*, 53*b*, and 53*c* during first heat storing operation. For example, the indoor fans 53*a*, 53*b*, and 53*c* may alternatively be controlled to have airflow volume less than airflow volume during normal operation of heating operation or mainly heating operation. This case also inhibits heat release from the secondary refrigerant in the utilization heat exchangers 52*a*, 52*b*, and 52*c*.

(12-4) Other Embodiment D

The above embodiment exemplifies the case where the utilization expansion valves 51*a*, 51*b*, and 51*c* are controlled into the closed state during second heat storing operation and defrosting operation.

However, second heat storing operation and defrosting operation are not limited to control to completely stop the utilization expansion valves 51*a*, 51*b*, and 51*c*. For example, the utilization expansion valves 51*a*, 51*b*, and 51*c* may alternatively be controlled to be smaller in valve opening degree in comparison to normal operation of heating operation or mainly heating operation. This case also inhibits quantity of the secondary refrigerant sent to the utilization heat exchangers 52*a*, 52*b*, and 52*c*, so as to inhibit heat release at the utilization heat exchangers 52*a*, 52*b*, and 52*c*.

Control to open, without closing, the utilization expansion valves 51*a*, 51*b*, and 51*c* may not be executed during heat storing operation or until satisfaction of the predetermined condition from the start of defrosting operation, but may be executed after the start of defrosting operation and upon satisfaction of the following condition. Specifically, examples of the condition include a case where the secondary refrigerant sucked into the secondary compressor 21 in the secondary refrigerant circuit 10 has a degree of superheating equal to or less than a predetermined value, a case where the secondary refrigerant discharged from the secondary compressor 21 has a degree of superheating equal to or less than a predetermined value, a case where the secondary refrigerant in the secondary refrigerant circuit 10 has high pressure equal to or less than a predetermined value, a case where the liquid refrigerant in the secondary refrigerant circuit 10 has temperature equal to or less than a predetermined value, and a case where defrosting operation cannot end even after elapse of predetermined time from the start of defrosting operation.

Whether or not the secondary refrigerant in the secondary refrigerant circuit 10 has high pressure equal to or less than the predetermined value may be exemplarily determined in accordance with pressure detected by the secondary discharge pressure sensor 38. Whether or not the liquid refrigerant in the secondary refrigerant circuit 10 has temperature equal to or less than the predetermined value may be determined in accordance with temperature detected by the receiver outlet temperature sensor 84, temperature detected by the subcooling outlet temperature sensor 86, or the like.

(12-5) Other Embodiment E

The above embodiment exemplifies control to supply the primary flow path 35*b* of the cascade heat exchanger 35 with the refrigerant discharged from the primary compressor 71 in the primary refrigerant circuit 5*a* during heat storing operation.

Alternatively, the primary compressor 71 may be stopped during heat storing operation. Furthermore, pressure equalizing control and control to switch the primary switching mechanism 72 may be completed to achieve the connection state enabling the start of defrosting operation, and the primary compressor 71 may be made standby to be activated until completion of heat storing operation.

Alternatively, the primary compressor 71 may be driven as in the above embodiment during first heat storing operation as heat storing operation, and the primary compressor 71 may be stopped during second heat storing operation, pressure equalizing control and control to switch the primary switching mechanism 72 may be completed, and the primary compressor 71 may be made standby to be activated until completion of heat storing operation. This avoids both the primary flow path 35*b* and the secondary flow path 35*a* of the cascade heat exchanger 35 from functioning as a refrigerant radiator during second heat storing operation, to inhibit abnormal increase of high pressure of the primary refrigerant or the secondary refrigerant.

(12-6) Other Embodiment F

The above embodiment exemplifies the case where the bypass expansion valve 46*a* is controlled to open so as to cause the secondary refrigerant to flow in the bypass circuit 46 during second heat storing operation and defrosting operation.

Alternatively, instead of causing the secondary refrigerant to flow to the bypass circuit 46 during second heat storing operation and defrosting operation, the subcooling expansion valve 48*a* may be controlled to open so as to cause the secondary refrigerant to flow to the subcooling circuit 48.

(12-7) Other Embodiment G

The above embodiment exemplifies R32 as the refrigerant provided in the primary refrigerant circuit 5*a* and carbon dioxide as the refrigerant provided in the secondary refrigerant circuit 10.

However, the refrigerant provided in the primary refrigerant circuit 5*a* should not be limited, and examples thereof include HFC-32, an HFO refrigerant, a refrigerant obtained by mixing HFC-32 and the HFO refrigerant, carbon dioxide, ammonia, and propane.

Furthermore, the refrigerant provided in the secondary refrigerant circuit 10 should not be limited, and examples thereof include HFC-32, an HFO refrigerant, a refrigerant obtained by mixing HFC-32 and the HFO refrigerant, carbon dioxide, ammonia, and propane.

Examples of the HFO refrigerant include HFO-1234yf and HFO-1234ze.

The primary refrigerant circuit 5*a* and the secondary refrigerant circuit 10 may adopt a same refrigerant or different refrigerants.

(12-8) Other Embodiment H

The above embodiment exemplifies, as the secondary refrigerant circuit 10, a refrigerant circuit having three pipes of the first connection pipe 8, the second connection pipe 9, and the third connection pipe 7, and configured to simultaneously execute cooling operation and heating operation.

However, the secondary refrigerant circuit 10 should not be limited to such a refrigerant circuit configured to simultaneously execute cooling operation and heating operation, and may be a circuit including the heat source unit 2 and the utilization units 3*a*, 3*b*, and 3*c* connected via two connection pipes.

(12-9) Other Embodiment I

The above embodiment exemplifies execution of first heat storing operation and second heat storing operation as heat storing operation before starting defrosting operation.

Alternatively, defrosting operation may start earlier upon satisfaction of the defrosting condition without execution of heat storing operation described above before the start of defrosting operation.

(12-10) Others

The cascade heat exchanger may be configured to cause heat exchange between the first refrigerant and the second refrigerant.

The refrigeration cycle system may include a control unit configured to execute the defrosting operation.

During the defrosting operation, the second refrigerant having passed the cascade heat exchanger may entirely flow into the bypass circuit, or the second refrigerant having passed the cascade heat exchanger may partially flow into the bypass circuit.

The portion between the utilization heat exchanger and the cascade heat exchanger may have a flow of the second refrigerant having high pressure or intermediate pressure during operation of causing the second refrigerant to flow from the second compressor toward the cascade heat exchanger.

During the defrosting operation, the controlling valve may be opened constantly or at least temporarily.

The controlling valve may be configured to be switchable between an opened state and a closed state, or may be configured to have a controllable valve opening degree.

In an exemplary case where the second circuit includes an accumulator provided downstream of the second compressor, the suction flow path of the second compressor can be a pipe including a flow path from the second switching unit to the accumulator and a flow path from the accumulator to the second compressor.

The opening degree of the expansion valve before the defrosting operation starts is not particularly limited, and can be an opening degree of the expansion valve during normal operation in the heating cycle, and the opening degree may be controlled in accordance with an operation condition. The opening degree may exemplarily be controlled in accordance with a degree of superheating of the second refrigerant sucked into the second compressor or a degree of superheating of the second refrigerant discharged from the second compressor.

Examples of the predetermined condition include a case where the degree of superheating of the second refrigerant sucked into the second compressor is equal to or less than a predetermined value, a case where the degree of superheating of the second refrigerant discharged from the second compressor is equal to or less than a predetermined value, a case where the pressure of the high pressure refrigerant in the refrigeration cycle of the second circuit is equal to or less than a predetermined value, and a case where the temperature of the second refrigerant flowing between the utilization heat exchanger and the cascade heat exchanger on the second circuit is equal to or less than a predetermined value.

Being downstream of the portion connected with the bypass circuit indicates being downstream in a flow direction of the second refrigerant in the suction flow path.

The refrigerant cooler may be configured to cool the refrigerant having passed the cascade heat exchanger and flowing toward the utilization heat exchanger.

When the second circuit includes the receiver provided between the cascade heat exchanger and the utilization heat exchanger and configured to reserve the second refrigerant, there may be provided two bypass circuits, namely, a bypass circuit passing the refrigerant cooler and a bypass circuit guiding the gas refrigerant in the receiver to the suction flow path of the second compressor. Furthermore, when the second circuit includes the receiver provided between the cascade heat exchanger and the utilization heat exchanger and configured to reserve the second refrigerant, the bypass circuit may cause the gas refrigerant in the receiver to pass the refrigerant cooler and then guide the refrigerant to the suction flow path of the second compressor.

Appendix

The embodiments of the present disclosure have been described above. Various modifications to modes and details should be available without departing from the object and the scope of the present disclosure recited in the patent claims.

REFERENCE SIGNS LIST

1: refrigeration cycle system
2: heat source unit
3*a*: first utilization unit
3*b*: second utilization unit
3*c*: third utilization unit
4: secondary unit
5: primary unit
5*a*: primary refrigerant circuit (first circuit)
7: liquid-refrigerant connection pipe
8: high and low-pressure gas-refrigerant connection pipe
9: low-pressure gas-refrigerant connection pipe
10: secondary refrigerant circuit (second circuit)
11: heat source expansion mechanism
12: heat source circuit
13*a-c*: utilization circuit
20: heat source control unit
21: secondary compressor (second compressor)
21*a*: compressor motor
22: secondary switching mechanism (second switching unit)
23: suction flow path
24: discharge flow path
25: third heat source pipe
26: fourth heat source pipe
27: fifth heat source pipe
28: first heat source pipe
29: second heat source pipe
30: accumulator
31: third shutoff valve
32: first shutoff valve
33: second shutoff valve
34: oil separator
35: cascade heat exchanger
35*a*: secondary flow path
35*b*: primary flow path
36: heat source expansion valve
37: secondary suction pressure sensor
38: secondary discharge pressure sensor
39: secondary discharge temperature sensor
40: oil return circuit
41: oil return flow path
42: oil return capillary tube
44: oil return on-off valve
45: receiver
46: bypass circuit (bypass circuit)
46*a*: bypass expansion valve (controlling valve)
47: subcooling heat exchanger (refrigerant cooler)
48: subcooling circuit (bypass circuit)
48*a*: subcooling expansion valve (controlling valve)
50*a-c*: utilization control unit
51*a-c*: utilization expansion valve (expansion valve)
52*a-c*: utilization heat exchanger (utilizing heat exchanger)
53*a-c*: indoor fan
56*a*, 56*b*, 56*c*: second utilization pipe
57*a*, 57*b*, 57*c*: first utilization pipe
58*a*, 58*b*, 58*c*: liquid-side temperature sensor
60*a*, 60*b*, 60*c*: branching unit control unit
61*a*, 61*b*, 61*c*: third branching pipe
62*a*, 62*b*, 62*c*: junction pipe
63*a*, 63*b*, 63*c*: first branching pipe
64*a*, 64*b*, 64*c*: second branching pipe
66*a*, 66*b*, 66*c*: first control valve
67*a*, 67*b*, 67*c*: second control valve
70: primary control unit
71: primary compressor (first compressor)
72: primary switching mechanism (first switching unit)
74: primary heat exchanger (heat source heat exchanger)
76: primary expansion valve
77: outdoor air temperature sensor
78: primary discharge pressure sensor
79: primary suction pressure sensor
81: primary suction temperature sensor
82: primary heat-exchange temperature sensor
83: secondary cascade temperature sensor
84: receiver outlet temperature sensor
85: bypass circuit temperature sensor
86: subcooling outlet temperature sensor
87: subcooling circuit temperature sensor
88: secondary suction temperature sensor
80: control unit

CITATION LIST

Patent Literature

Patent Literature 1: Japanese Laid-Open Patent Publication No. 2014-109405

The invention claimed is:

1. A refrigeration cycle system comprising:

a first circuit configured to circulate a first refrigerant and including a first compressor, a cascade heat exchanger, a heat source heat exchanger, and first switching valves configured to switch a flow path of the first refrigerant;

a second circuit configured to circulate a second refrigerant and including a second compressor, the cascade heat exchanger, a utilization heat exchanger; and second switching valves configured to switch a flow path of the second refrigerant; wherein the second circuit includes a bypass circuit connecting a portion between the utilization heat exchanger and the cascade heat exchanger and a suction flow path of the second compressor, and a controlling valve provided on the bypass circuit; and an electronic controller configured to control the system to executes defrosting operation of circulating the first refrigerant in the order of the first compressor, the heat source heat exchanger, and the cascade heat exchanger, and circulating the second refrigerant in the order of the second compressor, the cascade heat exchanger, and the bypass circuit.

2. The refrigeration cycle system according to claim 1, wherein the second circuit includes an expansion valve provided between the utilization heat exchanger and a site branching to the bypass circuit in the portion between the utilization heat exchanger and the cascade heat exchanger.

3. The refrigeration cycle system according to claim 2, wherein the electronic controller is configured to control the expansion valve during the defrosting operation to be smaller in opening degree than the expansion valve before the defrosting operation starts.

4. The refrigeration cycle system according to claim 2, wherein the electronic controller is configured to control the expansion valve to be in a closed state during the defrosting operation.

5. The refrigeration cycle system according to claim 2, wherein the electronic controller is configured to control, during the defrosting operation, the controlling valve to be decreased in opening degree and the expansion valve is increased in opening degree when at least one of a degree of superheating of the second refrigerant sucked into the second compressor, a degree of superheating of the second refrigerant discharged from the second compressor, pressure of a high pressure refrigerant in a refrigeration cycle of the second circuit, temperature of the second refrigerant flowing between the utilization heat exchanger and the cascade heat exchanger on the second circuit, and time elapsed from a start of the defrosting operation, satisfies a predetermined condition.

6. The refrigeration cycle system according to claim 1, wherein the second circuit includes an accumulator provided downstream of a portion connected with the bypass circuit on the suction flow path of the second compressor.

7. The refrigeration cycle system according to claim 1, wherein the second circuit includes a receiver provided between the cascade heat exchanger and the utilization heat exchanger and configured to reserve the second refrigerant, and the bypass circuit guides a gas refrigerant in the receiver to the suction flow path of the second compressor.

8. The refrigeration cycle system according to claim 1, wherein the second circuit includes a refrigerant cooler provided between the cascade heat exchanger and the utilization heat exchanger, and the bypass circuit passes the refrigerant cooler.

9. The refrigeration cycle system according to claim 3, wherein the electronic controller is configured to control, during the defrosting operation, the controlling valve to be decreased in opening degree and the expansion valve is increased in opening degree when at least one of a degree of superheating of the second refrigerant sucked into the second compressor, a degree of superheating of the second refrigerant discharged from the second compressor, pressure of a high pressure refrigerant in a refrigeration cycle of the second circuit, temperature of the second refrigerant flowing between the utilization heat exchanger and the cascade heat exchanger on the second circuit, and time elapsed from a start of the defrosting operation, satisfies a predetermined condition.

10. The refrigeration cycle system according to claim 4, wherein the electronic controller is configured to control, during the defrosting operation, the controlling valve to be decreased in opening degree and the expansion valve is increased in opening degree when at least one of a degree of superheating of the second refrigerant sucked into the second compressor, a degree of superheating of the second refrigerant discharged from the second compressor, pressure of a high pressure refrigerant in a refrigeration cycle of the second circuit, temperature of the second refrigerant flowing between the utilization heat exchanger and the cascade heat exchanger on the second circuit, and time elapsed from a start of the defrosting operation, satisfies a predetermined condition.

11. The refrigeration cycle system according to claim 2, wherein the second circuit includes an accumulator provided downstream of a portion connected with the bypass circuit on the suction flow path of the second compressor.

12. The refrigeration cycle system according to claim 3, wherein the second circuit includes an accumulator provided downstream of a portion connected with the bypass circuit on the suction flow path of the second compressor.

13. The refrigeration cycle system according to claim 4, wherein the second circuit includes an accumulator provided downstream of a portion connected with the bypass circuit on the suction flow path of the second compressor.

14. The refrigeration cycle system according to claim 5, wherein the second circuit includes an accumulator provided downstream of a portion connected with the bypass circuit on the suction flow path of the second compressor.

15. The refrigeration cycle system according to claim 2, wherein the second circuit includes a receiver provided between the cascade heat exchanger and the utilization heat exchanger and configured to reserve the second refrigerant, and the bypass circuit guides a gas refrigerant in the receiver to the suction flow path of the second compressor.

16. The refrigeration cycle system according to claim 3, wherein the second circuit includes a receiver provided between the cascade heat exchanger and the utilization heat exchanger and configured to reserve the second refrigerant, and the bypass circuit guides a gas refrigerant in the receiver to the suction flow path of the second compressor.

17. The refrigeration cycle system according to claim 4, wherein the second circuit includes a receiver provided between the cascade heat exchanger and the utilization heat exchanger and configured to reserve the second refrigerant, and the bypass circuit guides a gas refrigerant in the receiver to the suction flow path of the second compressor.

18. The refrigeration cycle system according to claim 5, wherein the second circuit includes a receiver provided between the cascade heat exchanger and the utilization heat exchanger and configured to reserve the second refrigerant, and the bypass circuit guides a gas refrigerant in the receiver to the suction flow path of the second compressor.

19. The refrigeration cycle system according to claim 6, wherein the second circuit includes a receiver provided between the cascade heat exchanger and the utilization heat exchanger and configured to reserve the second refrigerant, and the bypass circuit guides a gas refrigerant in the receiver to the suction flow path of the second compressor.

20. The refrigeration cycle system according to claim 2, wherein the second circuit includes a refrigerant cooler provided between the cascade heat exchanger and the utilization heat exchanger, and the bypass circuit passes the refrigerant cooler.

* * * * *